US011583070B2

(12) United States Patent
Sawhney et al.

(10) Patent No.: US 11,583,070 B2
(45) Date of Patent: Feb. 21, 2023

(54) INSTRUMENT AND MUSIC STAND

(71) Applicant: RKS VENTURES LLC, Thousand Oaks, CA (US)

(72) Inventors: Ravi Sawhney, Thousand Oaks, CA (US); John Michael Elam, Woodland Hills, CA (US); Michael Schuffert, Chatsworth, CA (US); Lance Hussey, Thousand Oaks, CA (US); Barry Mitchell, Thousand Oaks, CA (US); Carl Fronhofer, Thousand Oaks, CA (US); Jackson Hedden, Thousand Oaks, CA (US); John Vernon, Thousand Oaks, CA (US)

(73) Assignee: RKS Ventures LLC, Thousand Oaks, CA (US)

( * ) Notice: Subject to any disclaimer, the term of this patent is extended or adjusted under 35 U.S.C. 154(b) by 26 days.

(21) Appl. No.: 17/226,034

(22) Filed: Apr. 8, 2021

(65) Prior Publication Data

US 2021/0315376 A1 Oct. 14, 2021

Related U.S. Application Data

(60) Provisional application No. 63/006,894, filed on Apr. 8, 2020.

(51) Int. Cl.
*A47B 19/00* (2006.01)
*G10G 5/00* (2006.01)
(Continued)

(52) U.S. Cl.
CPC ..... *A47B 19/002* (2013.01); *A47B 19/08* (2013.01); *G10G 5/00* (2013.01); *G10G 7/00* (2013.01); *A47B 2019/006* (2013.01)

(58) Field of Classification Search
CPC ..... G10G 5/00; G10G 7/00; A47B 19/002; A47B 19/08; A47B 19/10; A47B 19/00; A47B 2019/006; F16M 11/041; F16M 11/28; F16B 21/16; F16B 2/12; F16B 7/00; F16B 7/04; F16B 7/0406; F16B 7/0413; F16B 7/042; F16B 21/06; F16B 21/065; Y10T 403/59; Y10T 403/591;
(Continued)

(56) References Cited

U.S. PATENT DOCUMENTS 498,564 A * 5/1893 Morris ..... E05D 3/12 16/354
755,403 A * 3/1904 Sipe ..... F16M 11/28 248/185.1

(Continued)

*Primary Examiner* — Ingrid M Weinhold
(74) *Attorney, Agent, or Firm* — Risso I.P.

(57) ABSTRACT

Described is a multi-purpose instrument and music stand. The instrument and music stand includes a base assembly having a plurality of legs. A rod projects up from the base assembly. At least one attachment tang with a pair of side recesses is pivotally attached with the rod. A tang receptor is included that selectively attaches with the attachment tang. The tang receptor is formed with a button and geared detent parts. Depressing the button causes the pair of geared detent parts to simultaneously retract from the pair of side recesses of the attachment tang, thereby allowing a user to selectively attach and detach a music holder or other item from the tang and stand.

7 Claims, 25 Drawing Sheets

(51) Int. Cl.
*A47B 19/08* (2006.01)
*G10G 7/00* (2006.01)

(58) Field of Classification Search
CPC ..... Y10T 24/4501; Y10T 16/541; Y10T 16/5401; Y10T 292/0977; Y10T 292/0993; Y10T 403/60; Y10T 403/602; Y10T 403/604; Y10S 403/04; Y10S 403/14; Y10S 292/37; E05D 3/06; E05D 3/122; E05D 11/1007; E05D 11/10; E05D 11/1014
USPC ... 248/464, 443, 178.1, 122.1, 125.9, 185.1, 248/314; 403/326–328, 290, 292, 403/319–321, 325, 361
See application file for complete search history.

(56) References Cited

U.S. PATENT DOCUMENTS 1,554,538 A * 9/1925 Walberg ..... A47B 19/002 248/409
3,423,056 A * 1/1969 Welt ..... F16M 11/2014 248/185.1
4,953,261 A * 9/1990 Lyons ..... E05D 3/12 16/354
5,564,661 A * 10/1996 Gershon ..... A47B 19/002 248/167
5,966,777 A * 10/1999 Jantschek ..... E04B 2/7431 16/354
5,979,856 A * 11/1999 Hsu ..... A47B 19/002 248/460
6,536,720 B1 * 3/2003 Yu ..... F16M 11/10 248/185.1
7,099,148 B2 * 8/2006 Lee ..... F16M 11/10 361/679.21
7,938,570 B2 * 5/2011 Lee ..... F21V 21/116 362/652
9,330,645 B2 5/2016 Sawhney et al.
D866,231 S * 11/2019 Sawhney ..... D6/682
D949,952 S * 4/2022 Luo ..... D16/244
2002/0056794 A1 * 5/2002 Ibrahim ..... A47B 19/00 248/432
2003/0052237 A1 * 3/2003 Yu ..... A47B 19/002 248/125.8
2005/0016354 A1 * 1/2005 Kent ..... F16M 11/28 84/327
2008/0265116 A1 * 10/2008 Chen ..... G10G 5/00 248/291.1
2014/0252196 A1 * 9/2014 Abady ..... E05D 7/00 248/463
2015/0115123 A1 * 4/2015 Ng ..... F16M 11/28 248/462

* cited by examiner

100

100

100

SECTION G-G
SCALE 1 : 1

DETAIL A
SCALE 1 : 1

SECTION H-H
SCALE 1 : 1

INSTRUMENT AND MUSIC STAND

CROSS-REFERENCE TO RELATED APPLICATIONS

This is a non-provisional application of U.S. Provisional Application No. 63/006,894, filed on Apr. 8, 2020, the entirety of which is incorporated herein by reference.

BACKGROUND OF THE INVENTION

(1) Field of Invention

The present invention relates to a music stand and, more specifically, to a multi-purpose instrument and music stand.

(2) Description of Related Art

Music stands have long been known in the art. However, they all suffer from a variety of defects. Thus, a continuing need exists for a new and improved instrument and music stand.

SUMMARY OF INVENTION

The present invention relates to a music stand and, more specifically, to a multi-purpose instrument and music stand. In one aspect, the instrument and music stand comprises a base assembly having a plurality of legs; a rod projecting up from the base assembly; at least one attachment tang pivotally attached with the rod; and a tang receptor formed to selectively attach with the at least one attachment tang.

In another aspect, the at least one attachment tang includes a pair of side recesses and wherein the tang receptor is formed to selectively attach with the at least one attachment tang by locking against the pair of side recesses.

In yet another aspect, the tang receptor further comprises a button operably connected with a pair of geared detent parts, whereby depressing the button causes the pair of geared detent parts to simultaneously retract from the pair of side recesses of the attachment tang.

In another aspect, a music holder is affixed with the tang receptor.

In yet another aspect, the music holder has two halves that are hingedly connected with one another by a pair of geared hinges.

Further, in another aspect, each geared hinge comprises at least two hinge parts with opposing faces, such that the opposing facings each have a magnet positioned therein.

In yet another aspect, the tang receptor includes a top side and a bottom side, with the tang receptor being formed to receive and selectively attach with an attachment tang from either the top or bottom side.

In another aspect, the at least one attachment tang includes three attachment tangs connected with a tang plate, the tang plate being pivotally connected with the rod.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a music stand and, more specifically, to a multi-purpose instrument and music stand. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
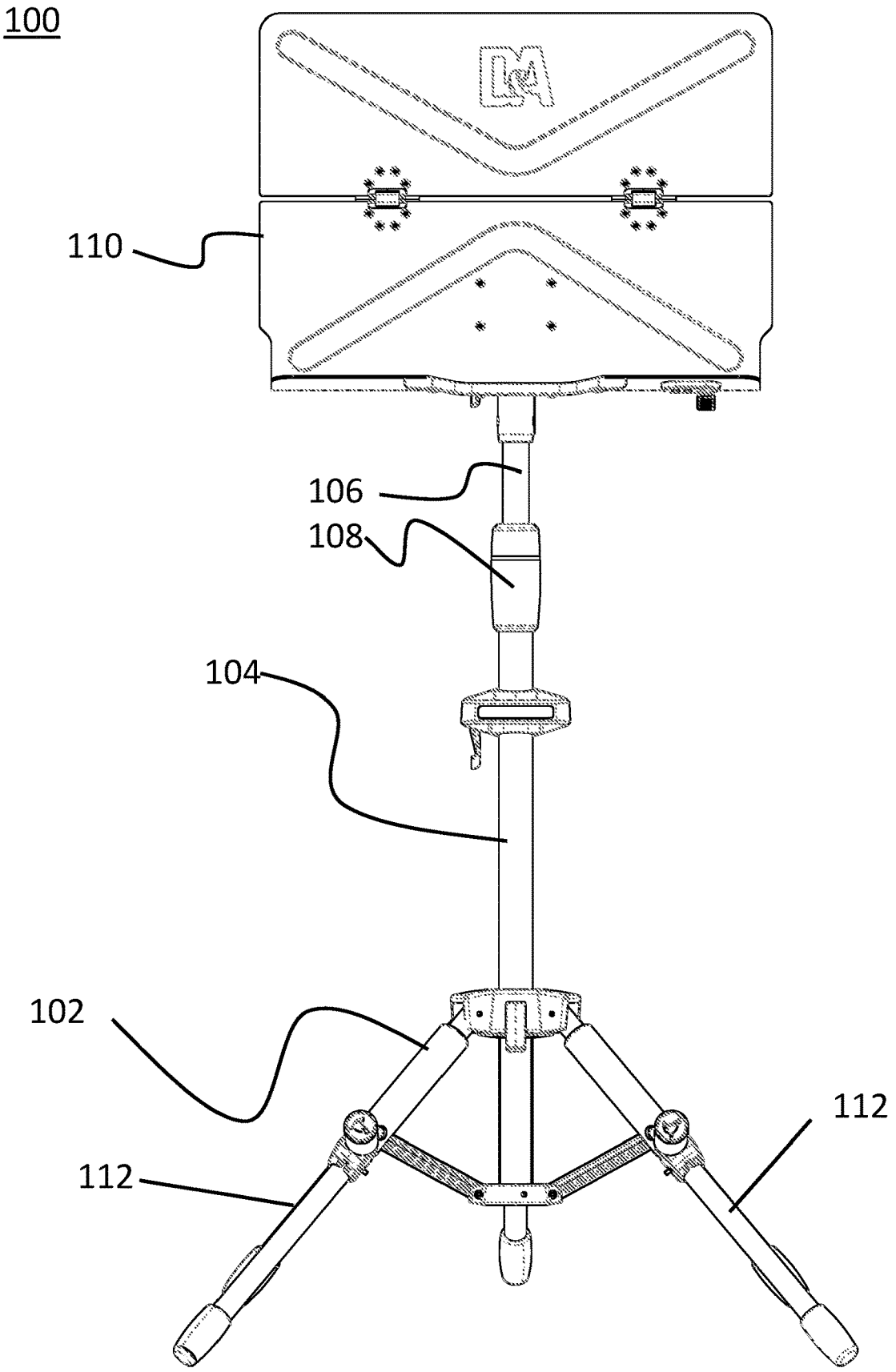
FIG. 1 is a front-view illustration of an instrument and music stand according to various embodiments of the present invention.

As noted above and as depicted in FIG. 1, the present disclosure is directed to an instrument and music stand 100. The stand 100 includes a base assembly 102 with any suitable mechanism or device to hold the stand in a stable position. Desirably and in one aspect, the base assembly 102 includes the plurality of legs and stabilizers as described and illustrated throughout U.S. Pat. No. 9,330,645, the entirety of which is incorporated herein by reference. In this aspect, the base assembly 102 includes a plurality of collapsible legs (including a pair of long front legs 112) that are formed to allow the stand 100 to be stable in an angled position, as depicted in FIG. 3.

A rod 104 rises from the base assembly 102. In a desired aspect, the rod 104 is adjustable. Thus, as a non-limiting example, the rod 104 includes an inner sliding rod 106 that as affixed with a lockable collar 108 that allows for selective height adjustment of the rod 104. The lockable collar 108 is any suitable mechanism or device that allows a user to selectively lock the inner sliding rod 106 at a desired height.

Figure 2:
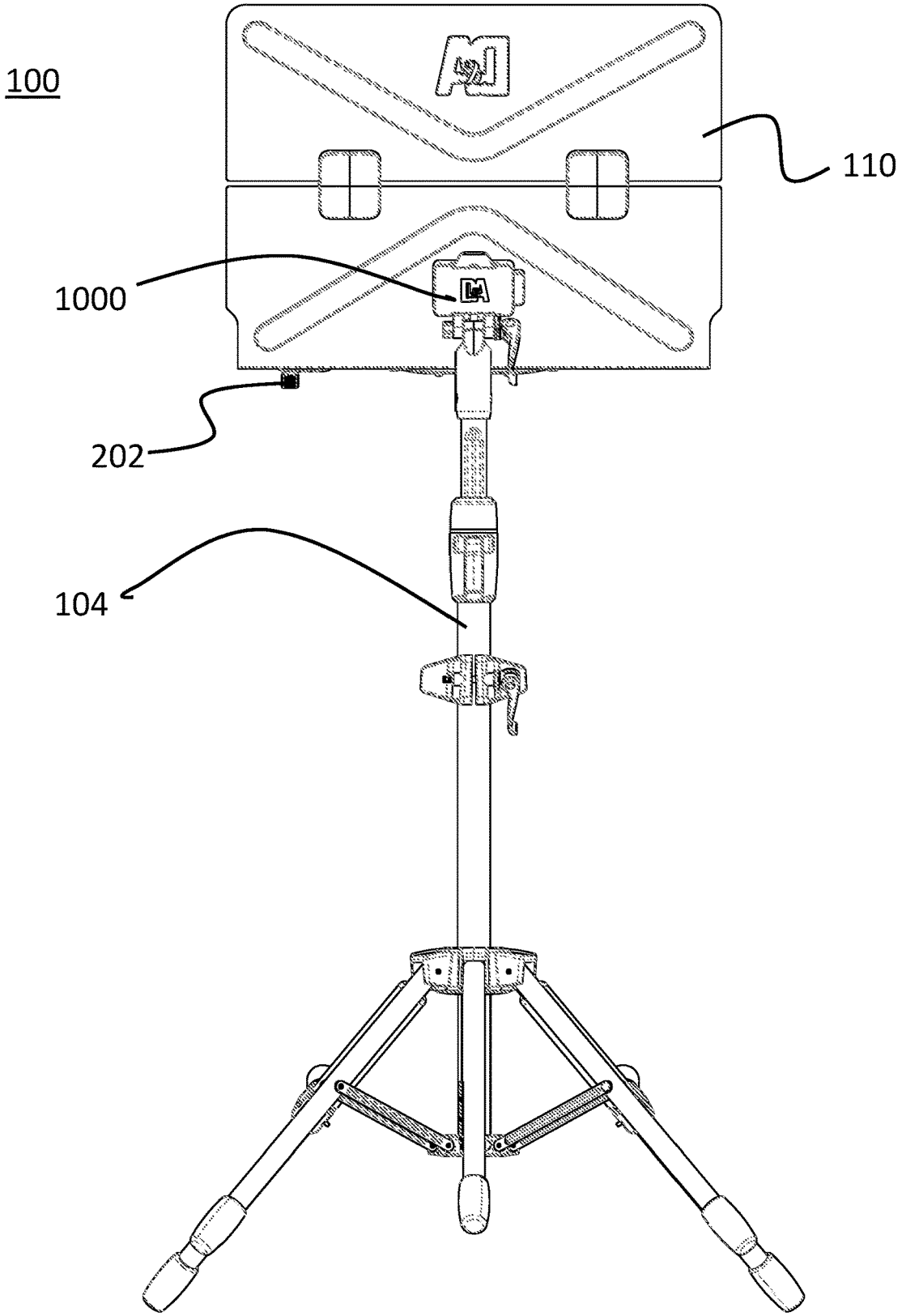
FIG. 2 is a rear-view illustration of the instrument and music stand according to various embodiments of the present invention.

Notably, the stand 100 includes a music holder 110 affixed with the distal end of the rod 104. As described in further detail below, the music holder along with its various attachments and components provide the music stand 100 with several innovative features that are a marked improvement of the prior art. For example and as shown in the rear-view illustration of FIG. 2, a tang receptor 1000 affixed with the back of the music holder 110. The tang receptor 1000 is used to allow for selective attachment/detachment of the music holder 110 to the stand 100. In one aspect, a pen holder 202 is optionally attached to a bottom side of the music holder 110.

Figure 3:
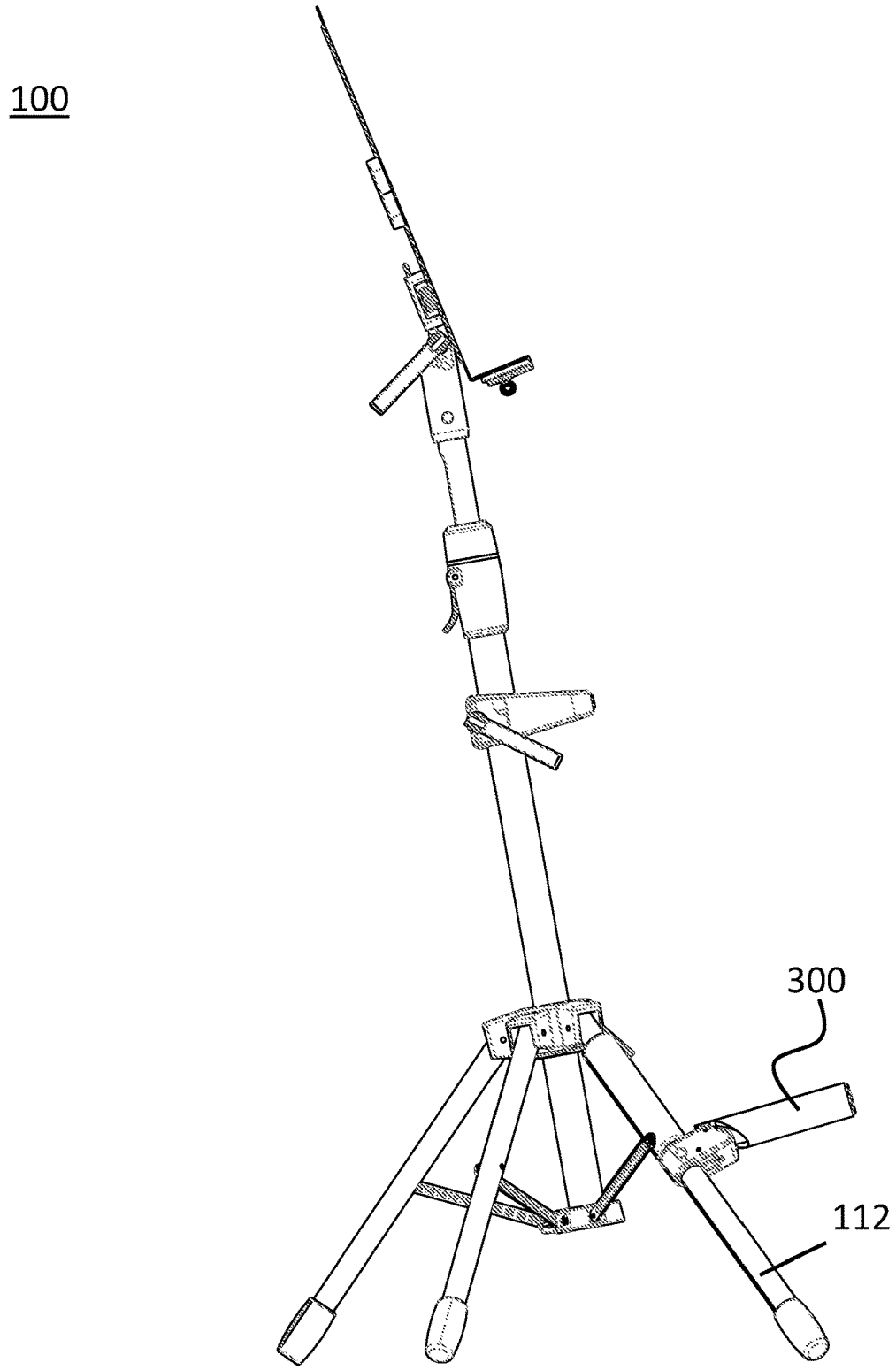
FIG. 3 is a right, side-view illustration of the instrument and music stand according to various embodiments of the present invention, depicting an instrument holders in an extended position.
Figure 4:
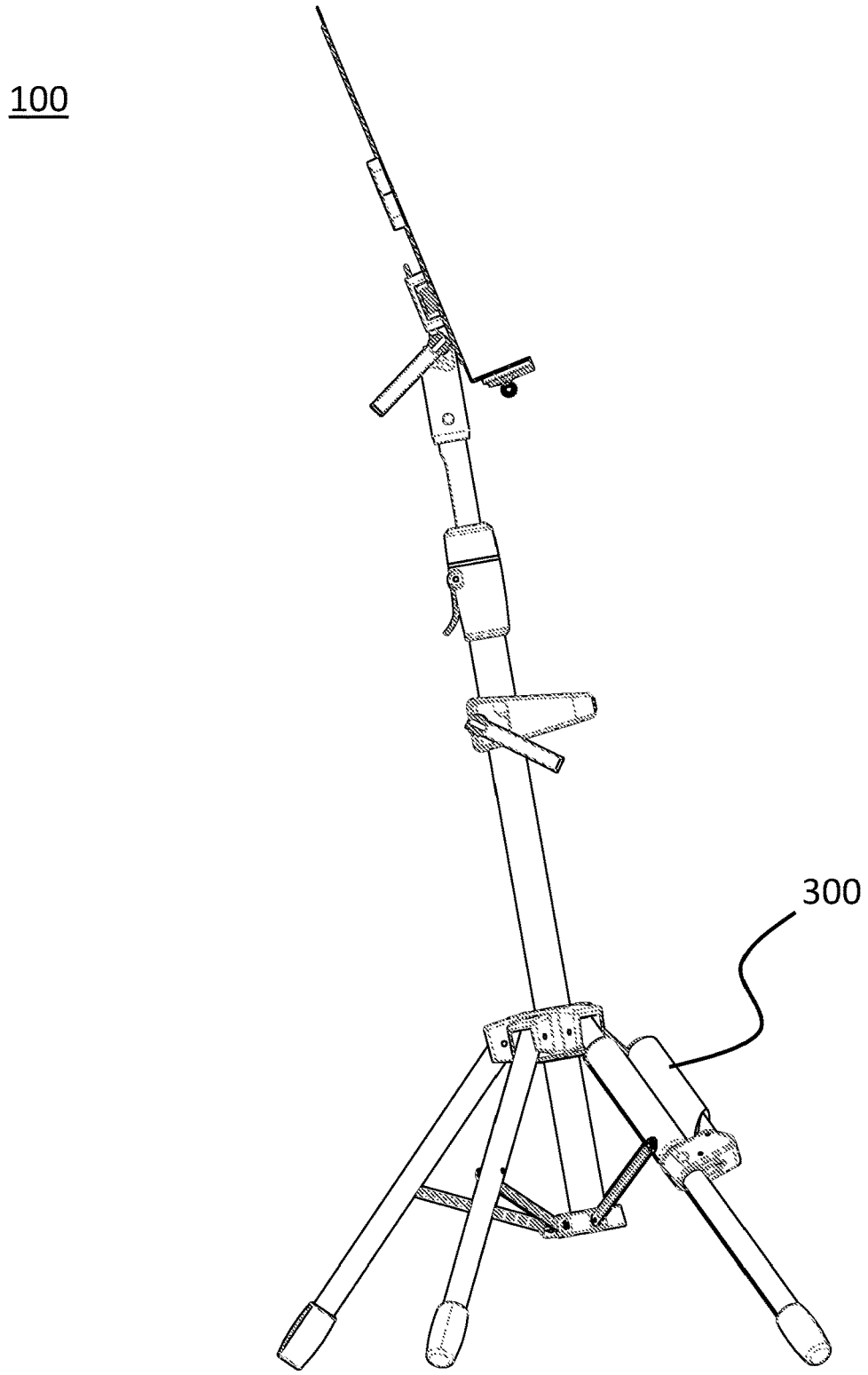
FIG. 4 is a right, side-view illustration of the instrument and music stand according to various embodiments of the present invention, depicting the instrument holders in a folded-up position.
Figure 5:
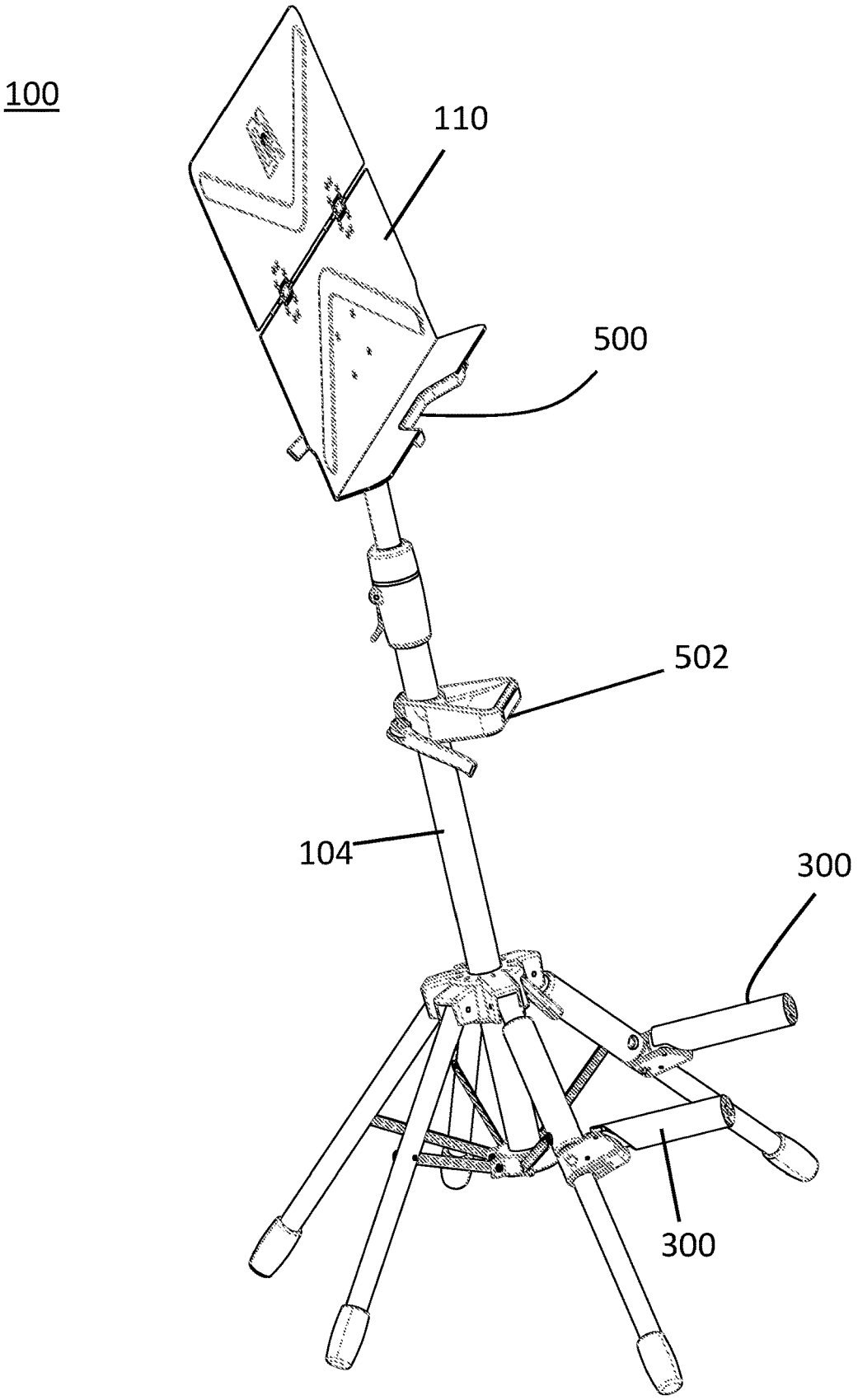
FIG. 5 is an elevated-view illustration of the instrument and music stand according to various embodiments of the present invention.
Figure 6:
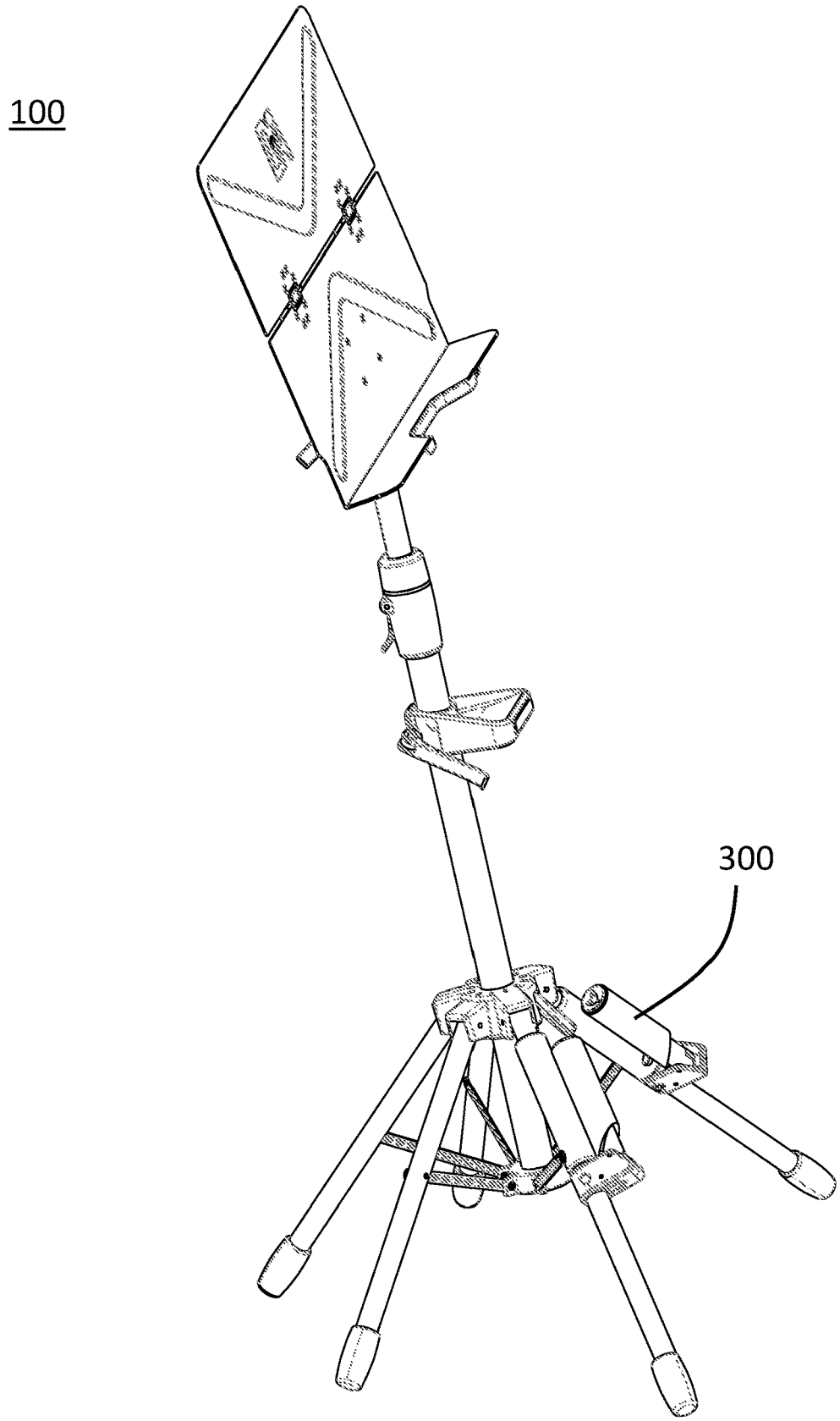
FIG. 6 is an elevated-view illustration of the instrument and music stand according to various embodiments of the present invention.

As shown in the side-view illustration of FIG. 3, the stand 100 includes hinged instrument holders 300. The hinged instrument holders 300 are attached with each of the front legs 112. The instrument holders 300 flip down on bi-stable springs to give retention in both up and down positions to provide for ease of use. FIG. 4 depicts the stand 100 with the instrument holders 300 as folded up into the compact position for storage or other instances in which it may not be desirable to have the holders extended. For further understanding, FIG. 5 depicts the stand 100 with the holders 300 folded out for use. As can be appreciated by those skilled in the art, the stand 100 can be used to hold a variety of guitars. For example, the music holder 110 can be formed with a notch 500 on its face to accommodate the neck of a guitar. A pic tray 502 can optionally be attached with the rod 104. In this aspect, when a guitar is positioned upon the holders 300, the back of the guitar will rest against the pic tray 502 with the neck of the guitar resting within the notch 500. For contrast, FIG. 6 depicts an aspect in which the holders 300 have been folded back up into the compact position.

Figure 7:
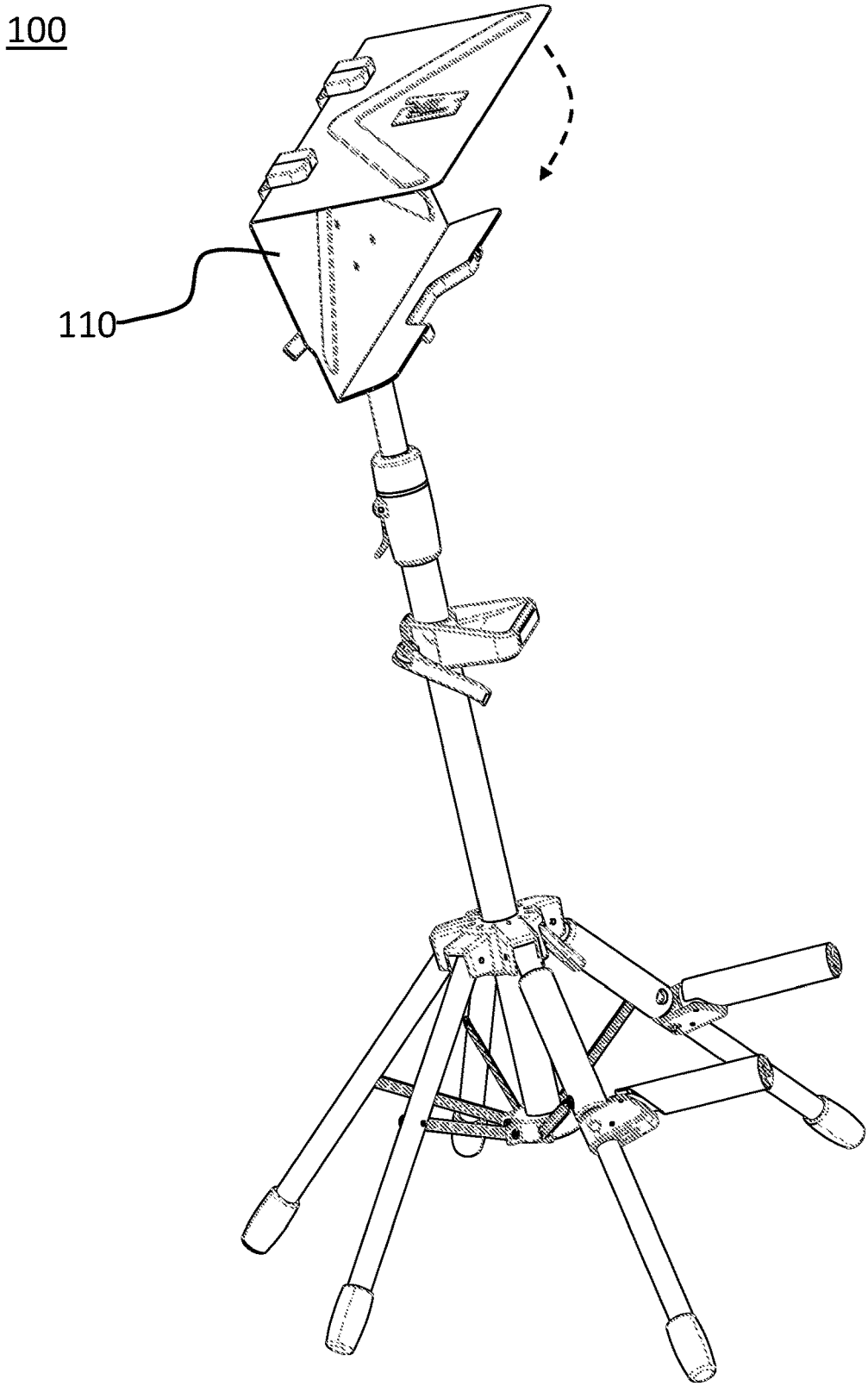
FIG. 7 is an elevated-view illustration of the instrument and music stand according to various embodiments of the present invention, depicting the music holder being folded.
Figure 8:
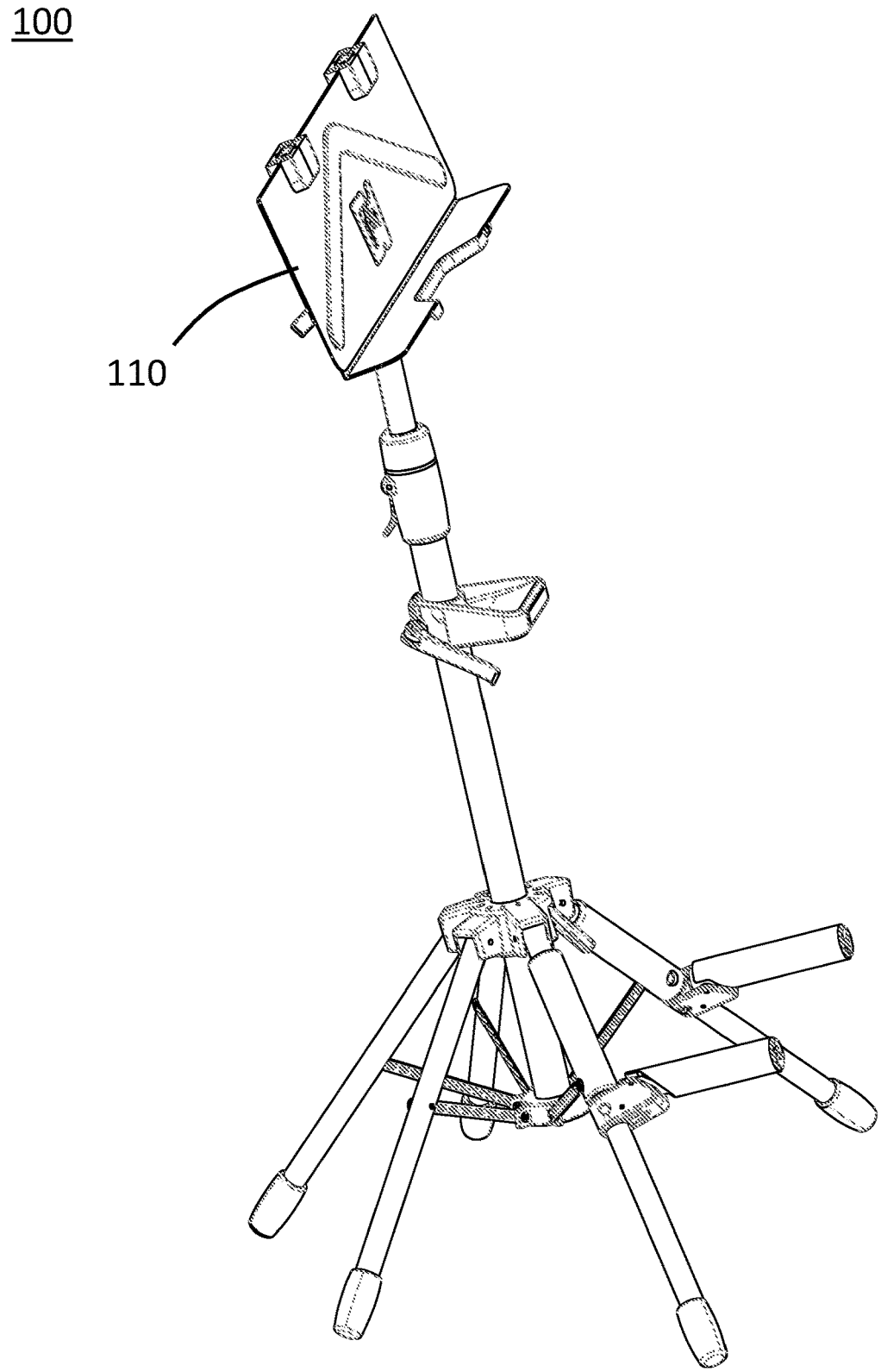
FIG. 8 is an elevated-view illustration of the instrument and music stand according to various embodiments of the present invention, depicting the music holder being folded into a compact position.
Figure 9:
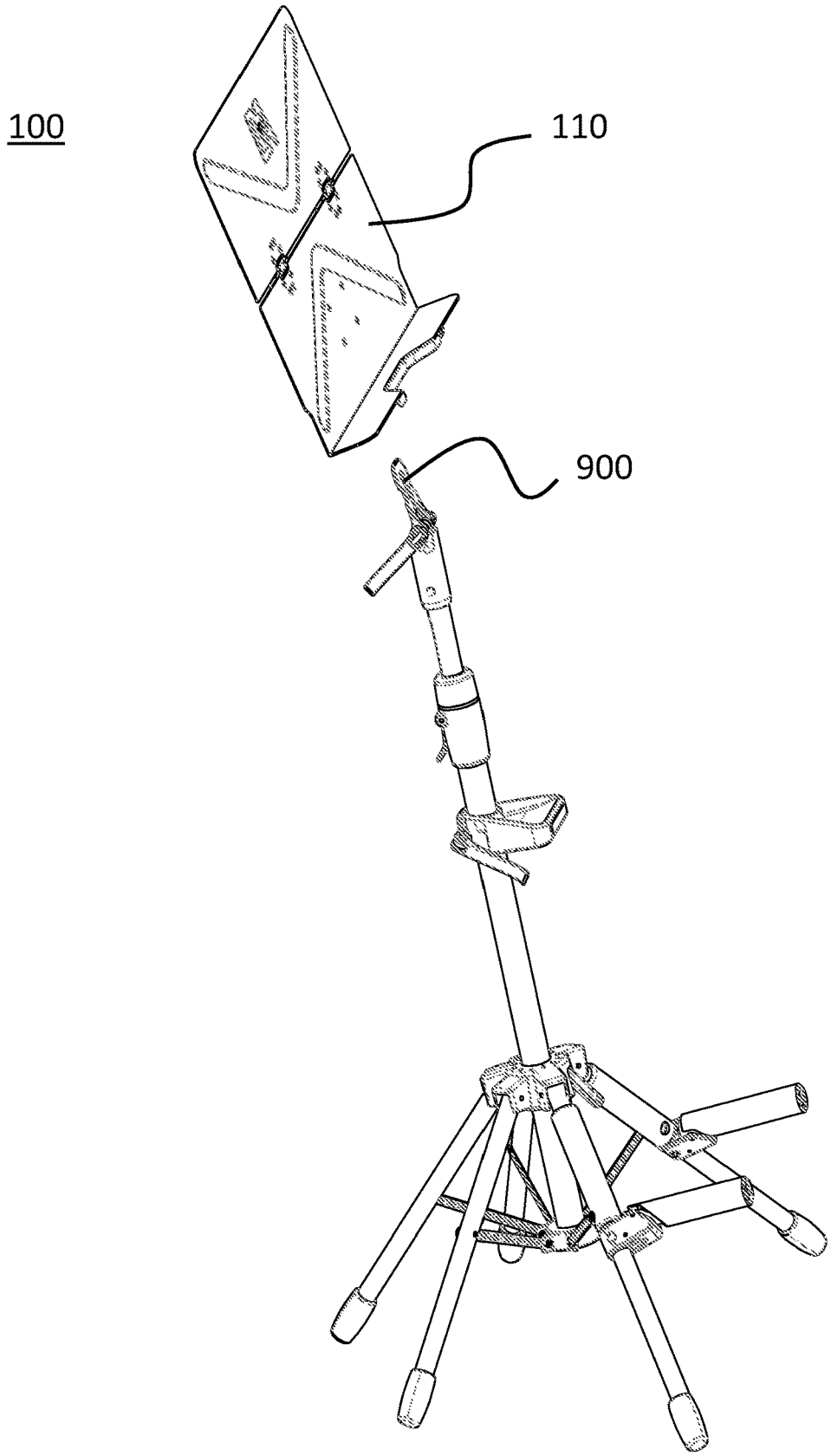
FIG. 9 is an elevated-view illustration of the instrument and music stand according to various embodiments of the present invention, depicting the music holder as being removed to expose an attachment tang.
Figure 10:
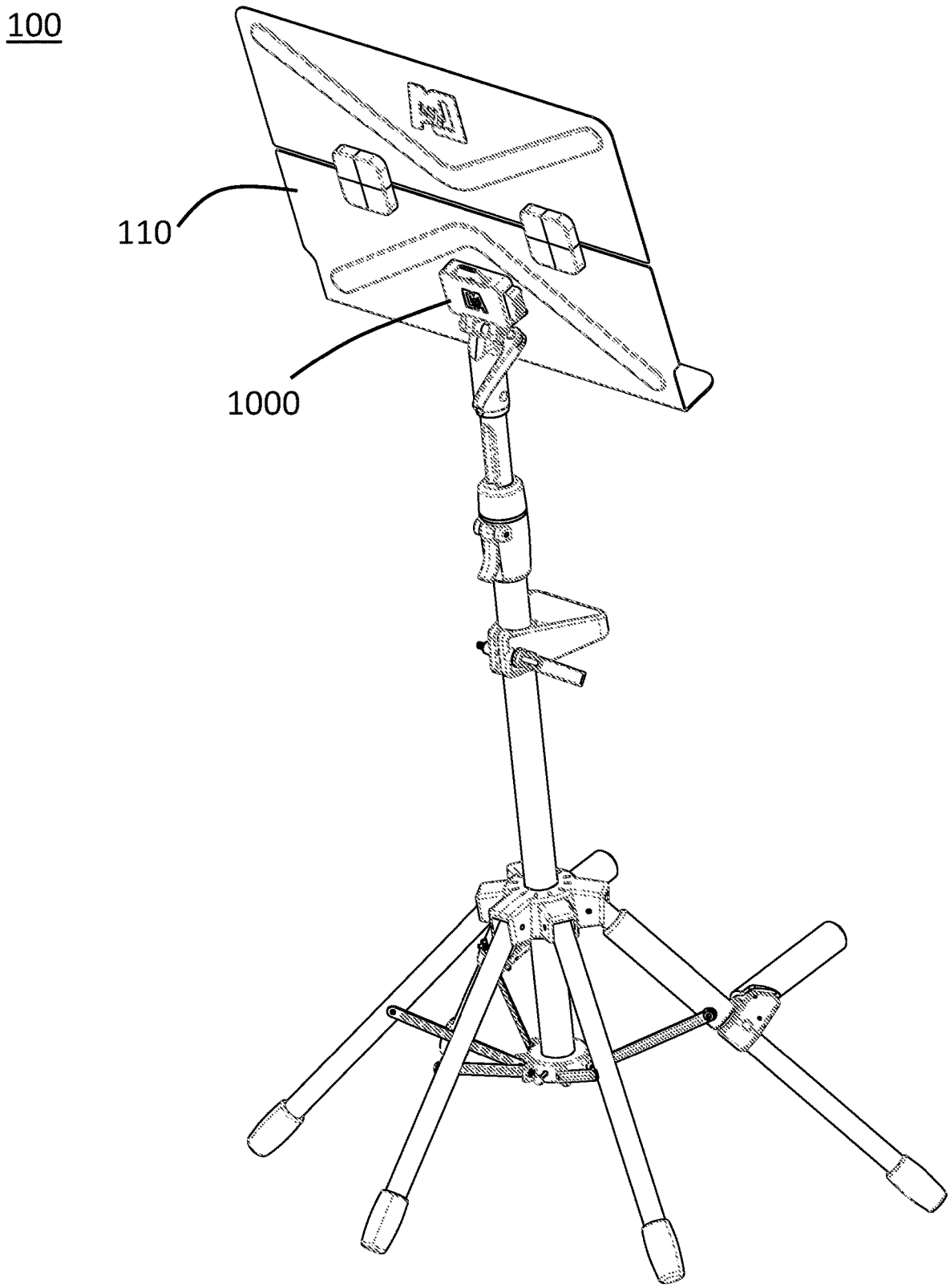
FIG. 10 is a rear, elevated-view illustration of the instrument and music stand according to various embodiments of the present invention.
Figure 11:
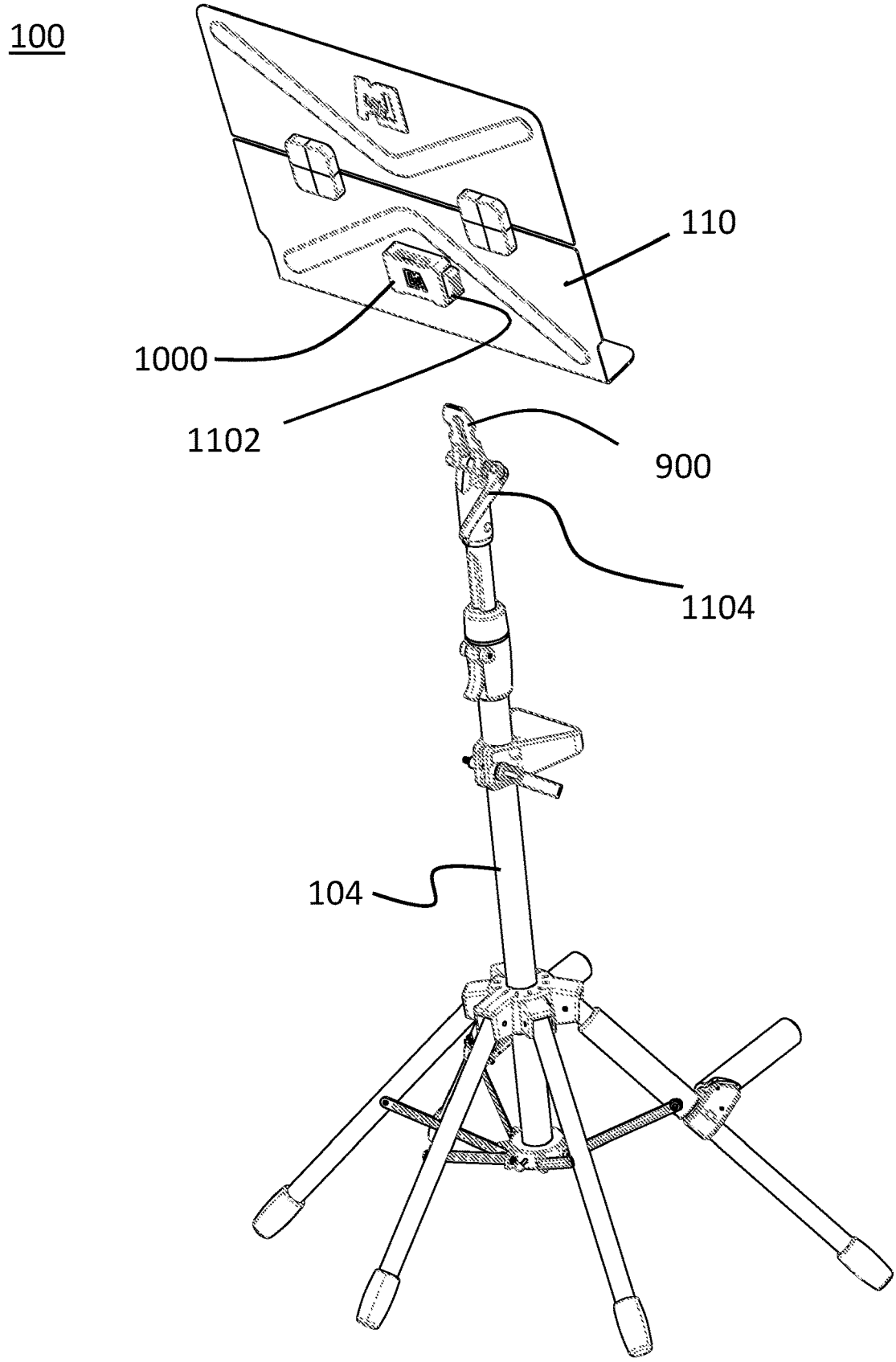
FIG. 11 is a rear, elevated-view illustration of the instrument and music stand according to various embodiments of the present invention, depicting the music holder as being removed from a tang receptor to expose an attachment tang.

The music holder 110 itself is also formed to provide advanced features and operation. For instance, FIGS. 7 and 8 depict the music holder 110 being folded in half to lower its profile into a compact storage position. Further and as noted above and depicted in FIG. 9, the music holder 110 is formed to allow for selective attachment/detachment from an attachment tang 900 on the stand 100. As shown in the rear-view illustration of FIG. 10, a tang receptor 1000 is used to affix the music holder 110 to the attachment tang. As shown in FIG. 11, a button 1102 or other mechanism or device of the tang receptor 1000 allows a user to selectively unlock the tang receptor 1000 from the attachment tang 900.

Figure 12:
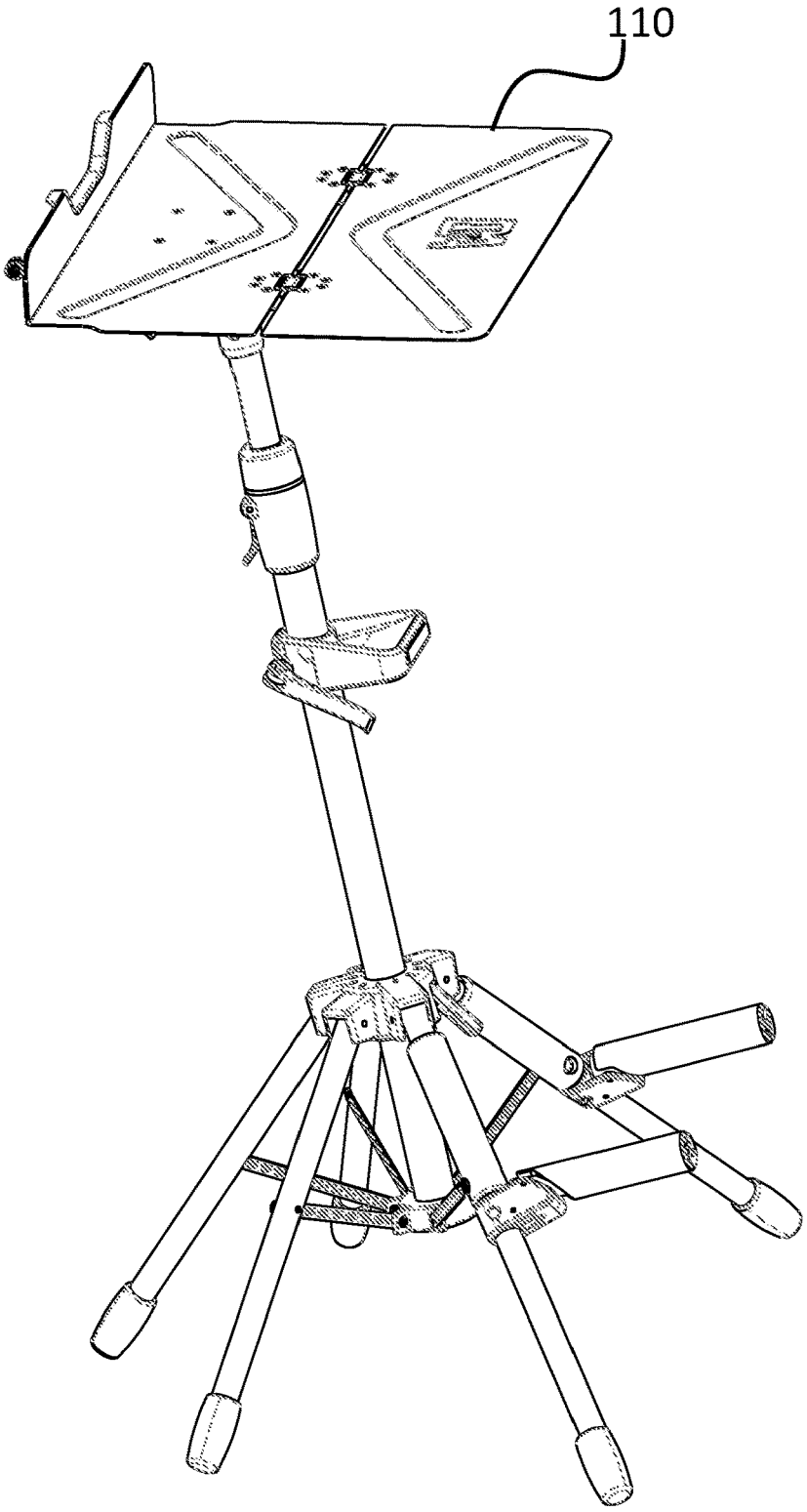
FIG. 12 is an elevated-view illustration of the instrument and music stand according to various embodiments of the present invention, depicting the music holder as being mounted in a flat position.
Figure 13:
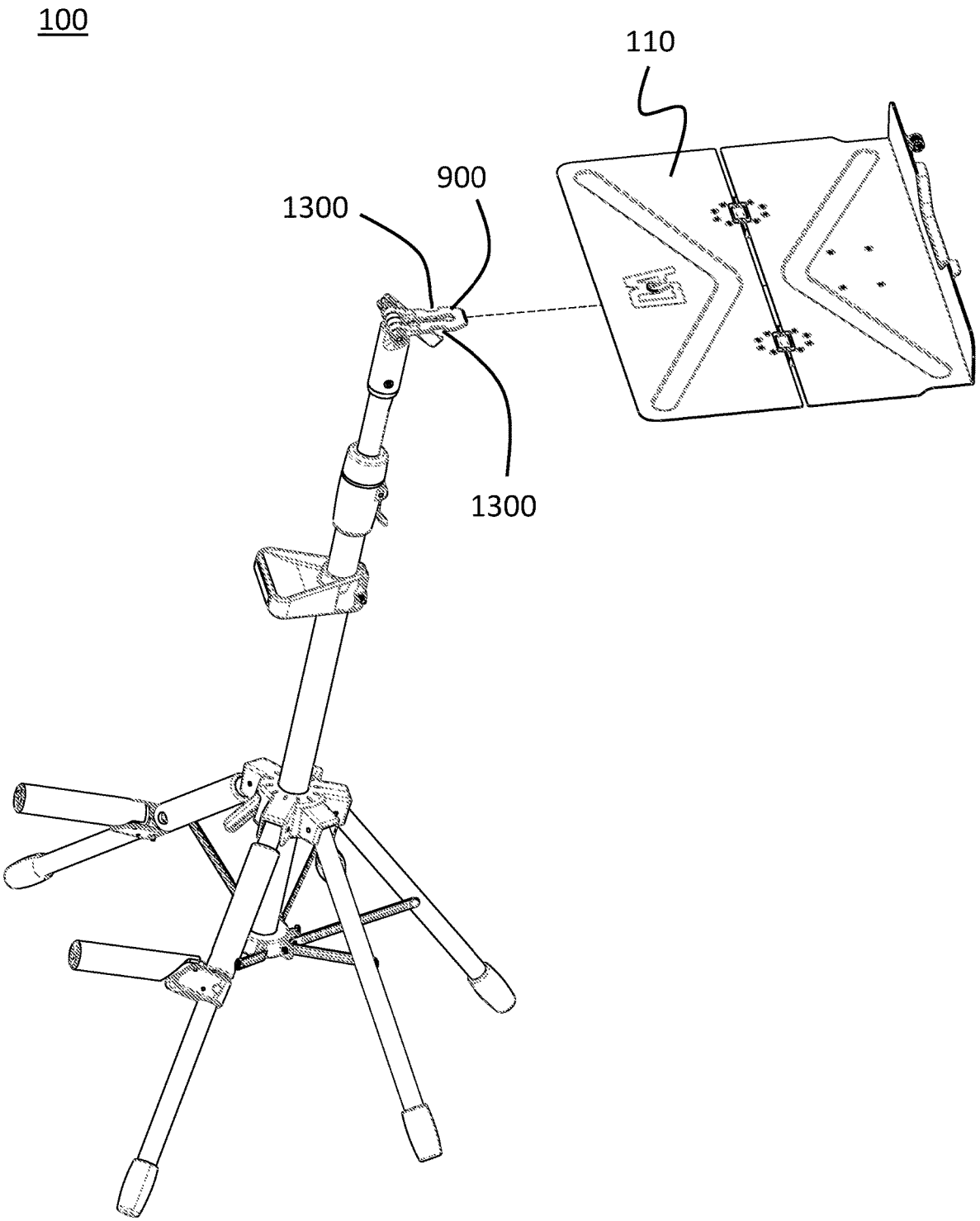
FIG. 13 is an elevated-view illustration of the instrument and music stand according to various embodiments of the present invention, depicting the tang as being positioned into a horizontal position to mount the music holder in the flat position.

In one aspect, the attachment tang 900 is pivotally connected with the rod 104 to allow a user to selectively angle the music holder 110. A screw type lock 1104 or other locking mechanism is included to allow for selectively locking the angle of the attachment tang 900. For example and as shown in FIGS. 12 and 13, the attachment tang 900 can be locked in a horizontal position to affix the music holder 110 in a flat orientation to hold a laptop or other item as desired.

Figure 14:
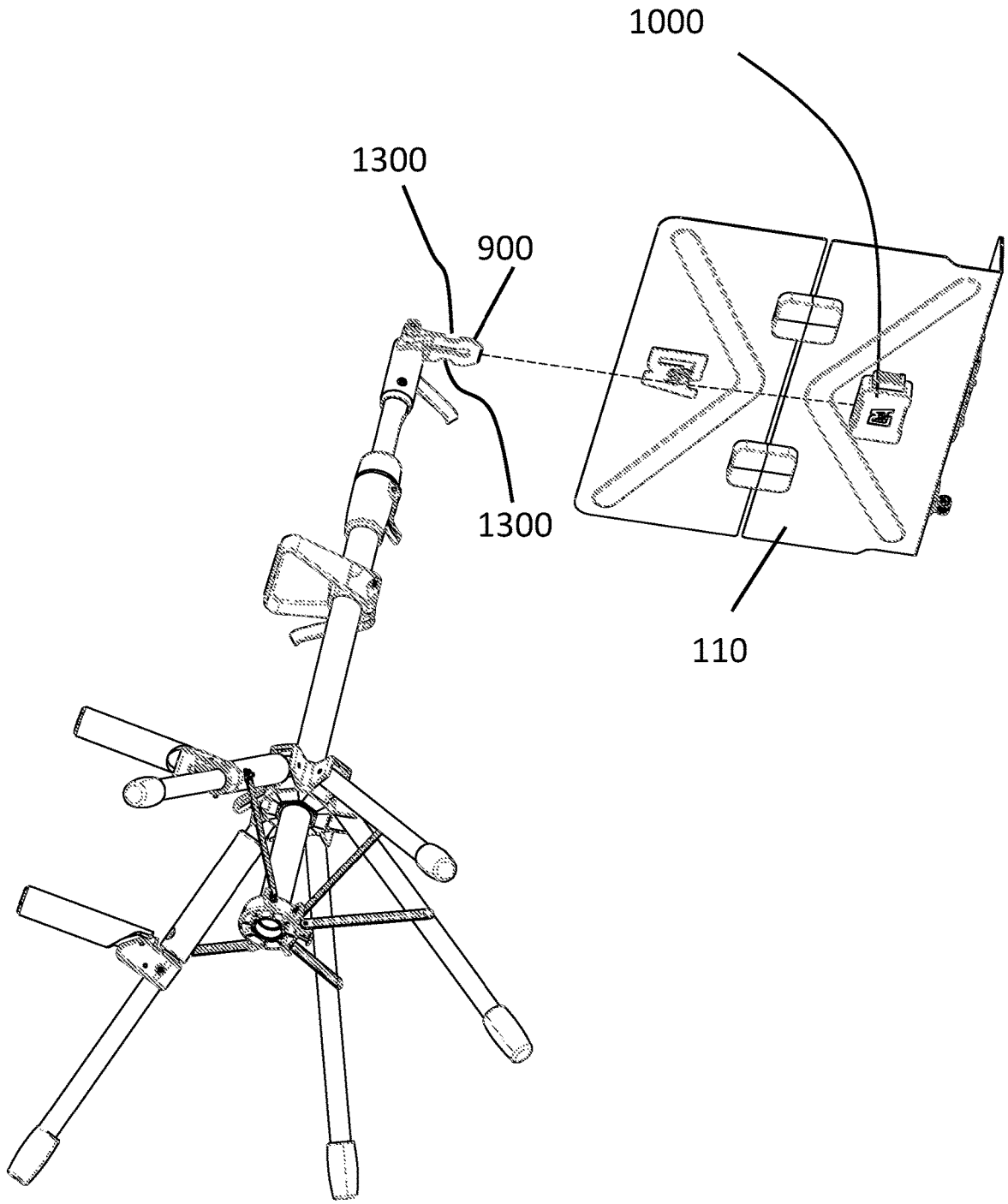
FIG. 14 is a bottom-view illustration of the instrument and music stand according to various embodiments of the present invention, depicting the music holder as turned around to engage with the tang to mount the music holder in the flat position.
Figure 15:
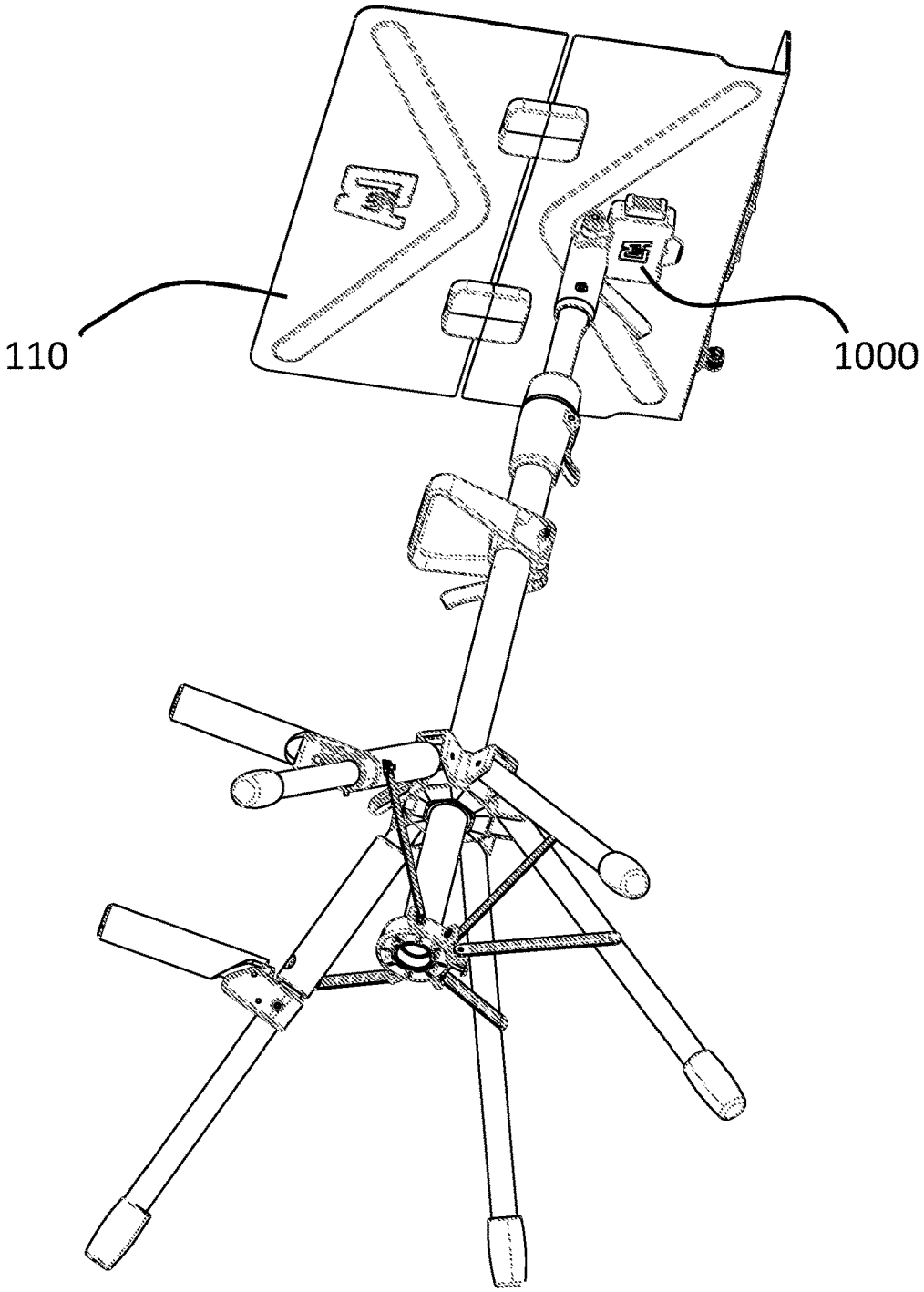
FIG. 15 is a bottom-view illustration of the instrument and music stand according to various embodiments of the present invention, depicting the music holder in the flat position, showing the center of gravity as positioned over the music stand.
Figure 16A:
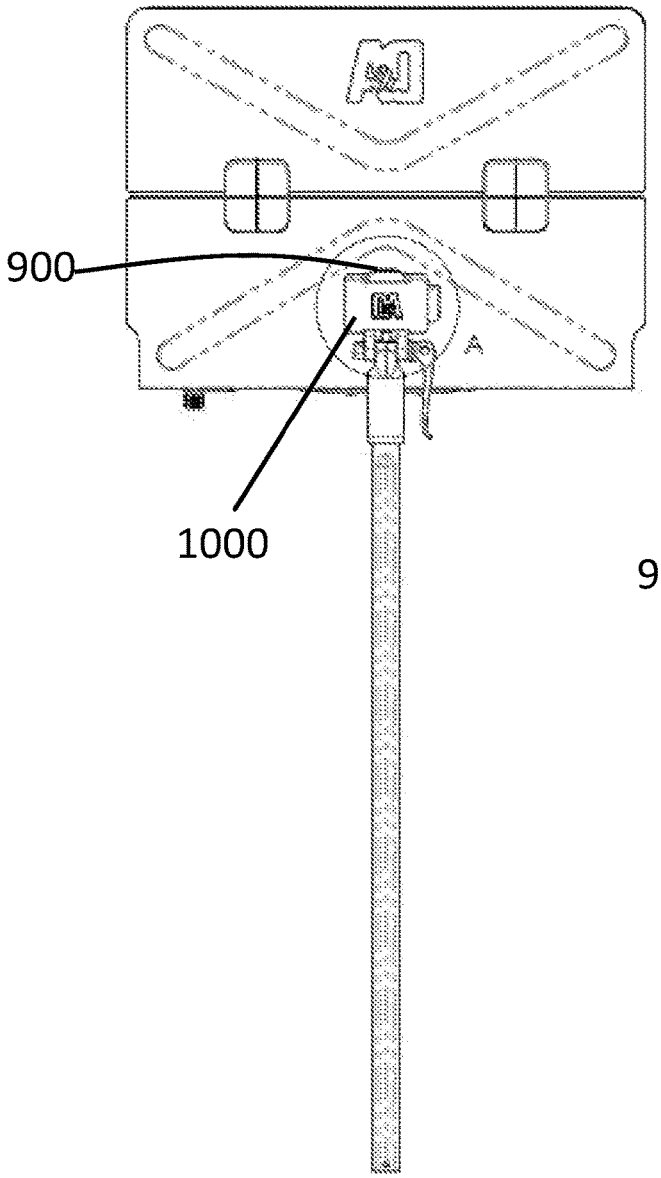
FIG. 16A is a rear-view illustration of the music holder.
Figure 16B:
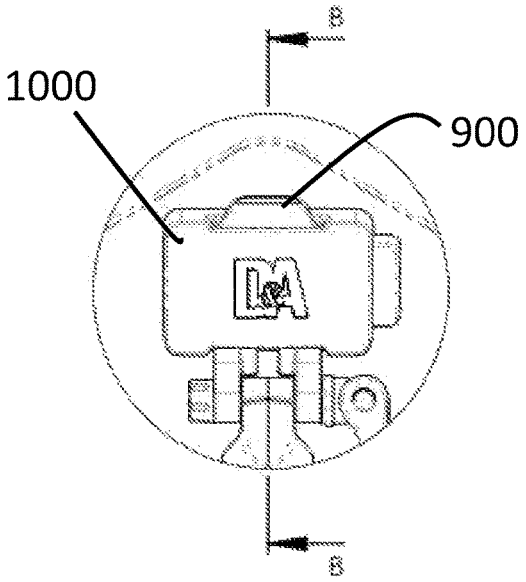
FIG. 16B is a close-up view illustration of the tang receptor.
Figure 16C:
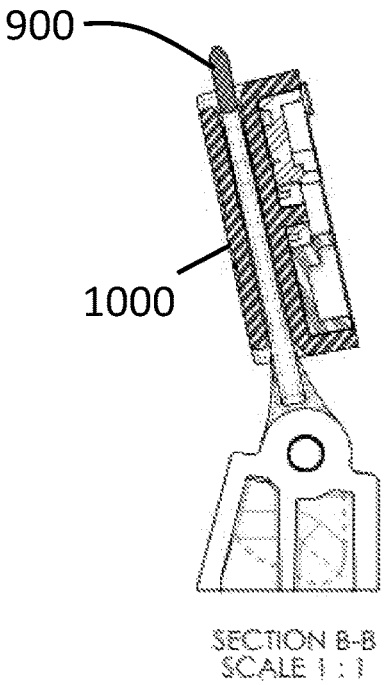
FIG. 16C is a cross-sectional, side-view illustration of the tang receptor taken from line B-B.

As shown in FIGS. 14 and 15, when one desires to position the music holder 110 in a flat position, the music holder 110 is turned around such that the attachment tang 900 is inserted into the opposite side (normally top side) of the tang receptor 1000. In doing so, the center of gravity remains over the top of the stand 100. This is because the tang receptor 1000 is attached with the music holder 110 at an off-center position such that when turned around, the majority of the music holder 110 is projected back over the top of the stand 100. Thus, the attachment tang 900 and tang receptor 1000 are formed to allow the attachment tang 900 to be positioned into the tang receptor 1000 from either the top or bottom side of the tang receptor 1000. For further understanding, FIGS. 16A through 16C depict the attachment tang 900 as positioned through and affixed with the tang receptor 1000.

Figure 17A:
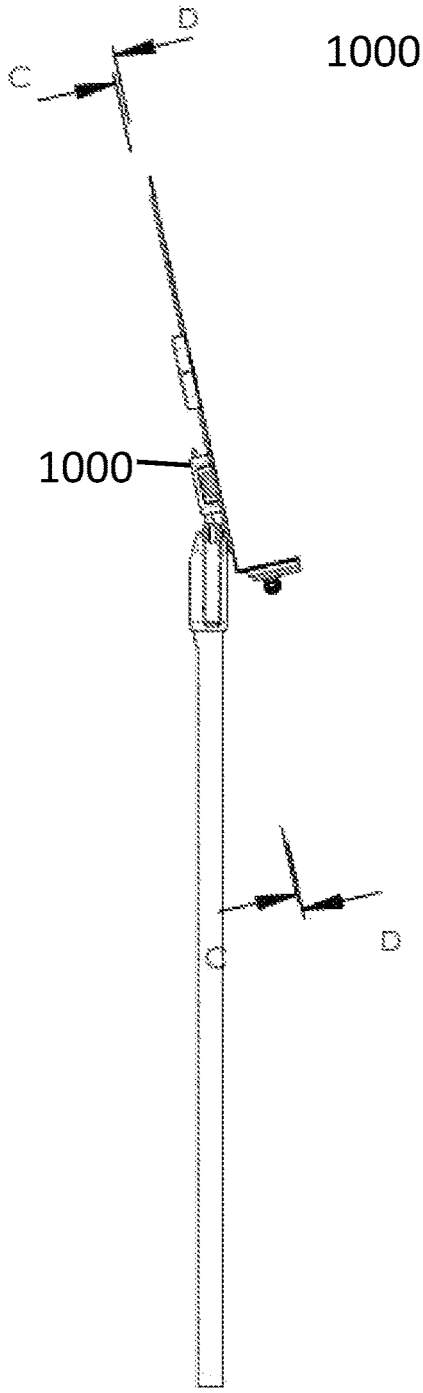
FIG. 17A is a side-view illustration of the music holder.
Figure 17B:
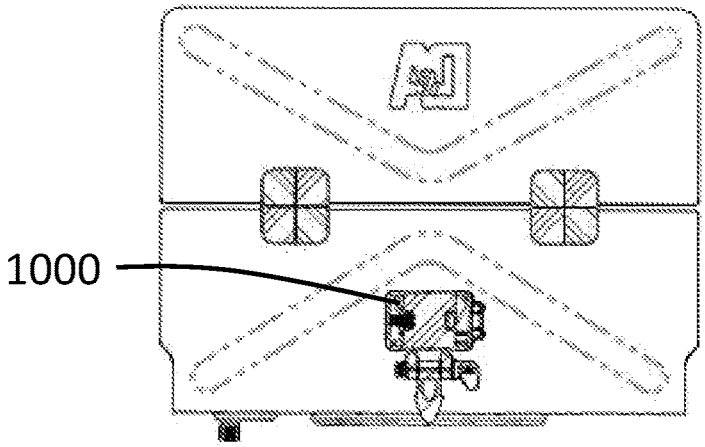
FIG. 17B is a cross-sectional, view illustration of the tang receptor taken from line C-C.
Figure 17C:
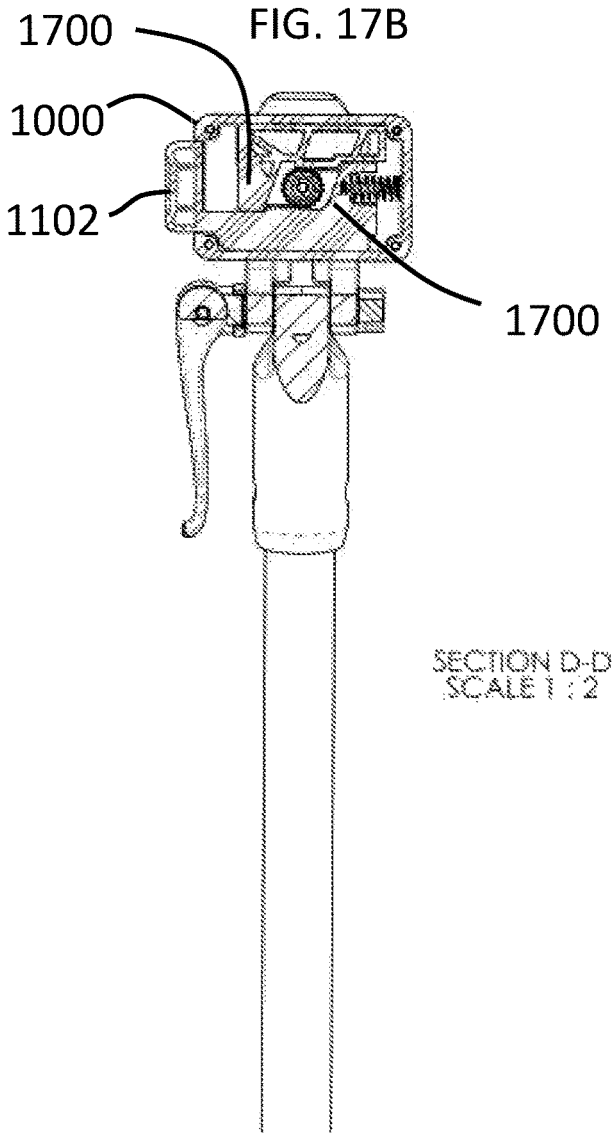
FIG. 17C is a cross-sectional, view illustration of the tang receptor taken from line D-D.
Figure 18:
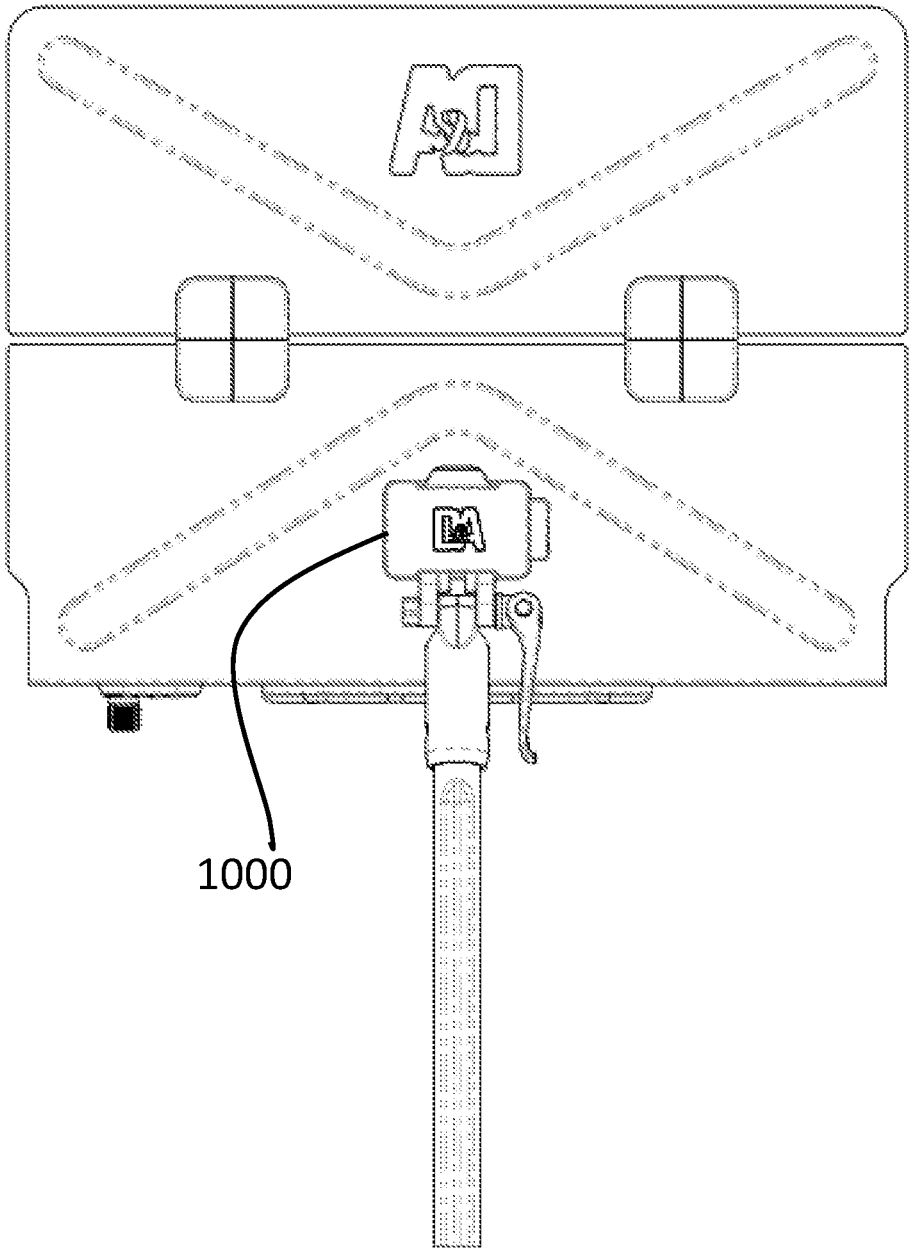
FIG. 18 is a rear-view illustration of the tang receptor.
Figure 19:
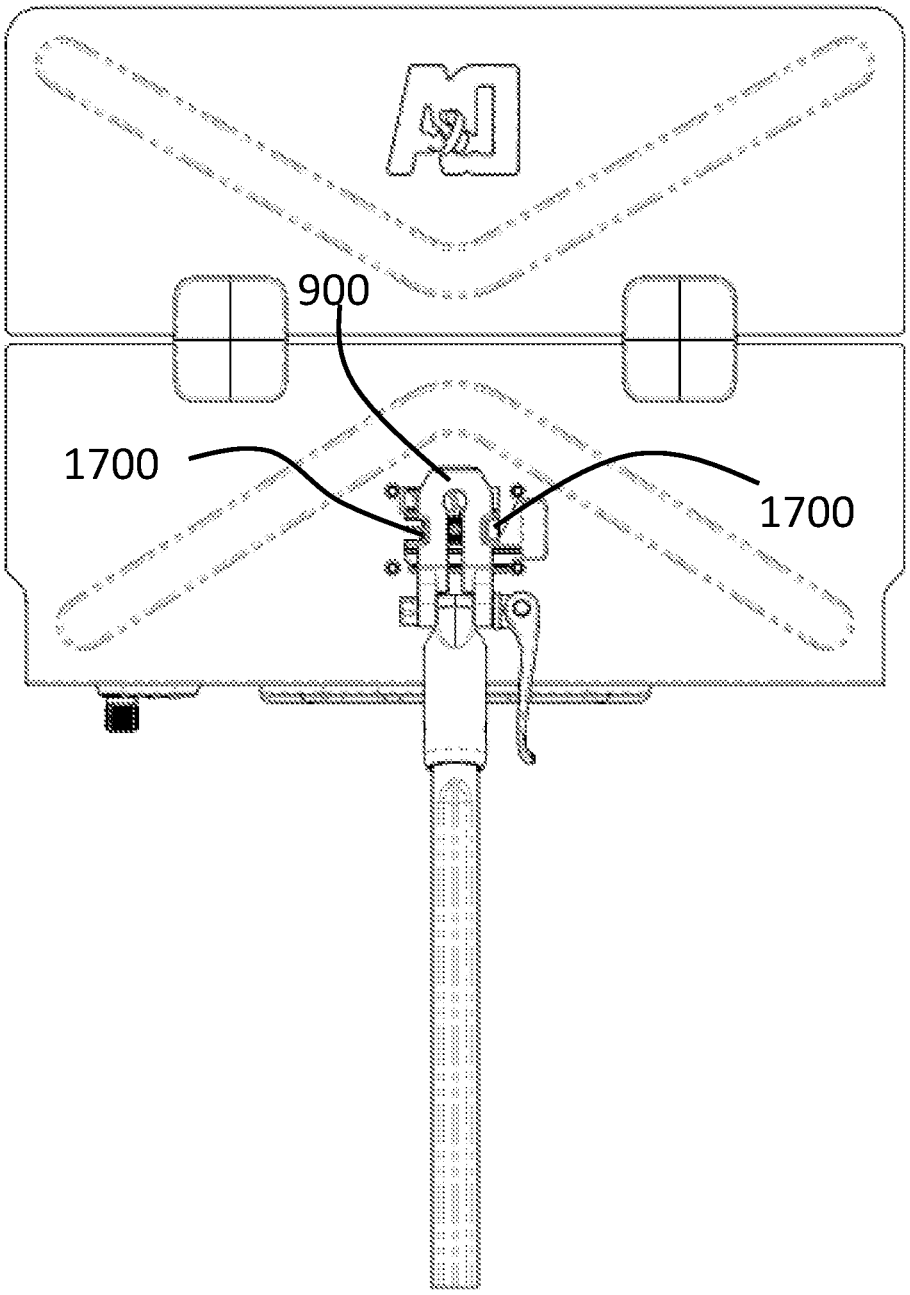
FIG. 19 is an interior-view illustration of the tang receptor.
Figure 20:
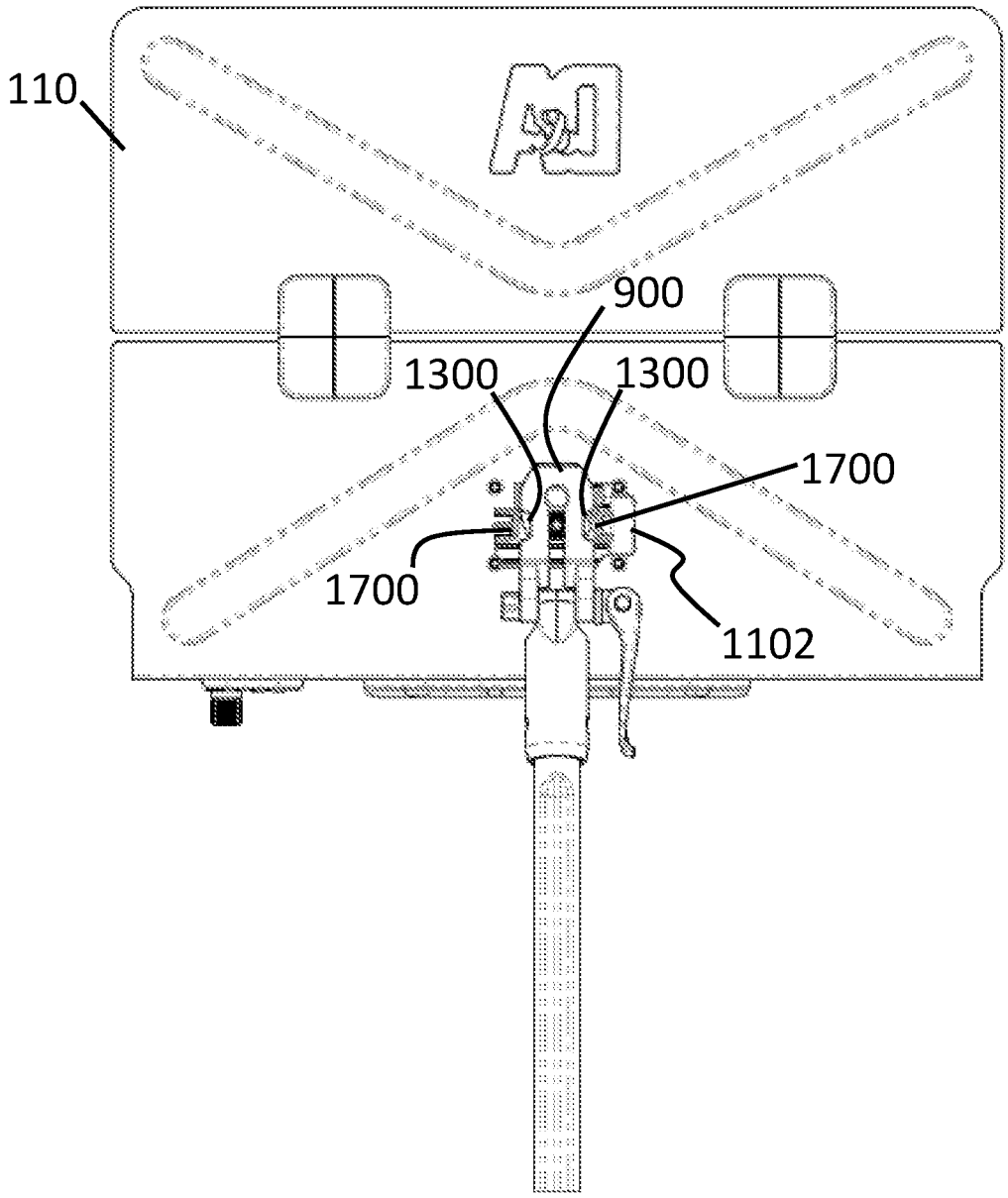
FIG. 20 is an interior-view illustration of the tang receptor.

The tang receptor 1000 is formed in any suitable manner to allow for selective attachment/detachment of the attachment tang 900. For example and as shown in FIGS. 13 and 14, the attachment tang 900 is formed to include side recesses 1300 that are affixed with retractable detents within the tang receptor 1000. This is further illustrated in FIGS. 17A through 20. In aspect and as shown in FIG. 17C, the tang receptor 1000 includes spring-loaded gearing that is operably connected with the button 1102 to provide simultaneous movements of the retractable detents out of the side recesses in the attachment tang. The detent parts 1700 are shown in FIG. 17C. For further understanding, FIG. 18 depicts the tang receptor 1000 as a whole, while FIGS. 19 and 20 provide interior views of the tang receptor. As shown in FIG. 19, the detent parts 1700 are positioned within the side recesses of the attachment tang 900. In this view, the main receptor cover is removed for clarity. As shown in FIG. 20, when the button 1102 is depressed, the detent parts 1700 simultaneously retract and withdraw from both side recesses 1300, allowing a user to slide the tang receptor and music holder 110 off of the tang 900. Thus and as can be appreciated by those skilled in the art, the design of the tang 900 and tang receptor allow for insertion into either end of the tang receptor.

Figure 21A:
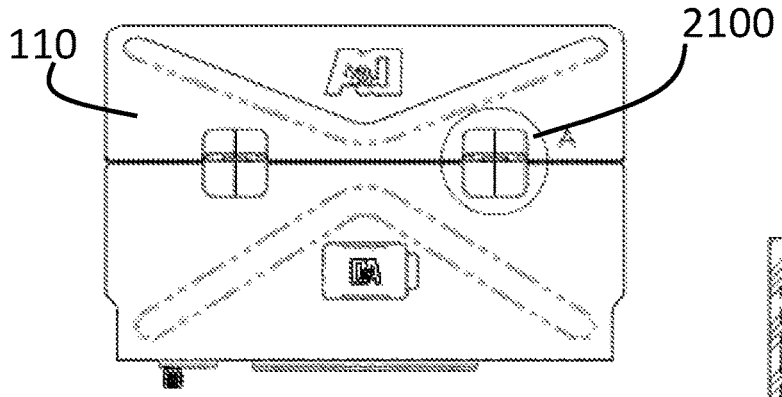
FIG. 21A is a rear-view illustration of a music holder, depicting music holder hinges.
Figure 21C:
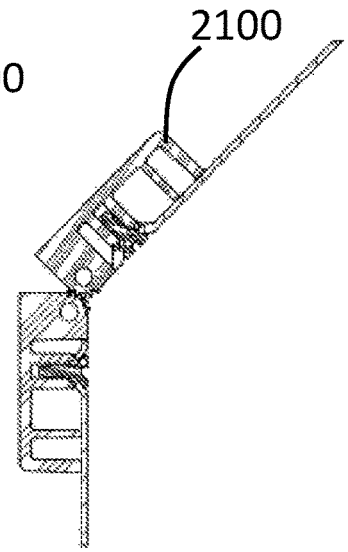
FIG. 21C is a cross-sectional, side-view illustration of the music holder hinge, taken from line G-G.
Figure 21B:
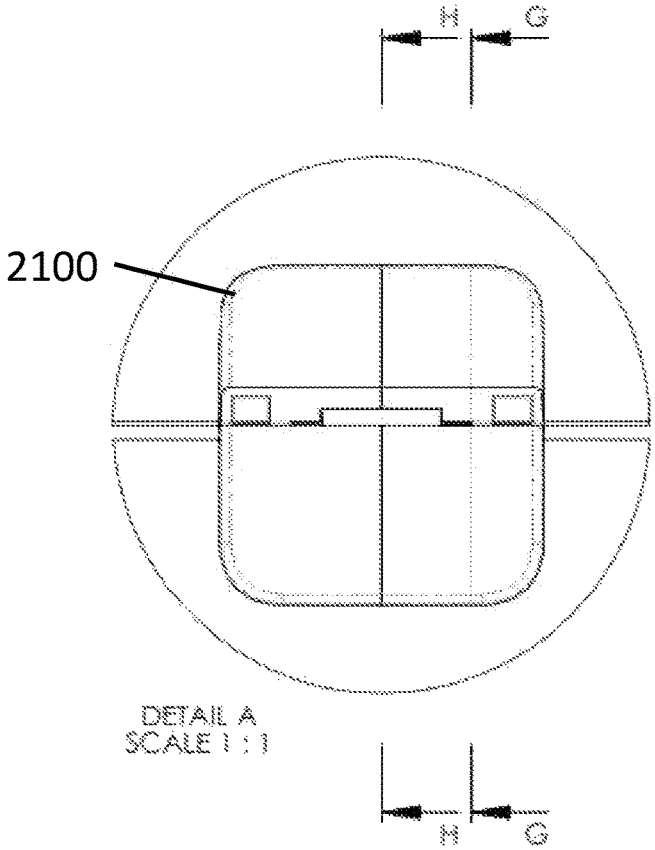
FIG. 21B is a close-up view illustration of a music holder hinge.
Figure 21D:
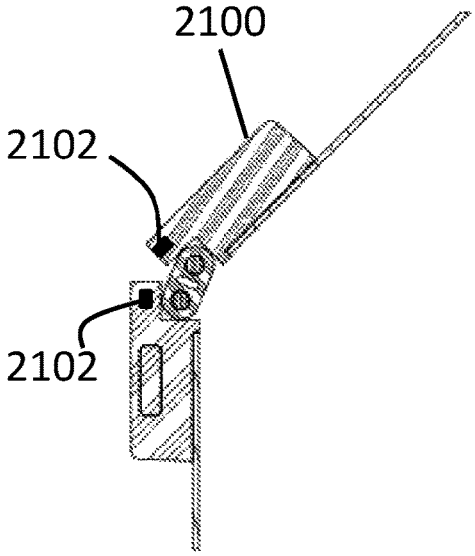
FIG. 21D is a cross-sectional, side-view illustration of the music holder hinge, taken from line H-H.

As noted above, the music holder 110 can be folded as desired. Thus, in one aspect, the music holder 110 is hinged to allow for selective folding. The hinged mechanism is any suitable mechanism or device that allows for selective folding of the music holder 110. As a non-limiting example and as depicted in FIGS. 21A through 21D, the backside of the music holder 110 includes a pair of geared hinges 2100 that allow the music holder 110 to fold in half. Each hinge 2100 includes two halves. Desirably and as shown in FIG. 21C, the two halves of the hinge 2100 are geared and linked to one another. The gearing and linkage achieves a flat fold without a mechanism or pivot protrusion beyond the flat face when unfolded. In some aspects and as shown in FIG. 21D, magnets 2102 are placed in opposing faces of the hinge parts. The magnets 2102 serve to hold music holder 110 open without mechanical latching, and provide a high-quality user experience. In other words, the magnets 2102 are keyed such that when the music holder 110 is open, the magnets 2102 adhere together to hold the music holder 110 in the open position.

Figure 22:
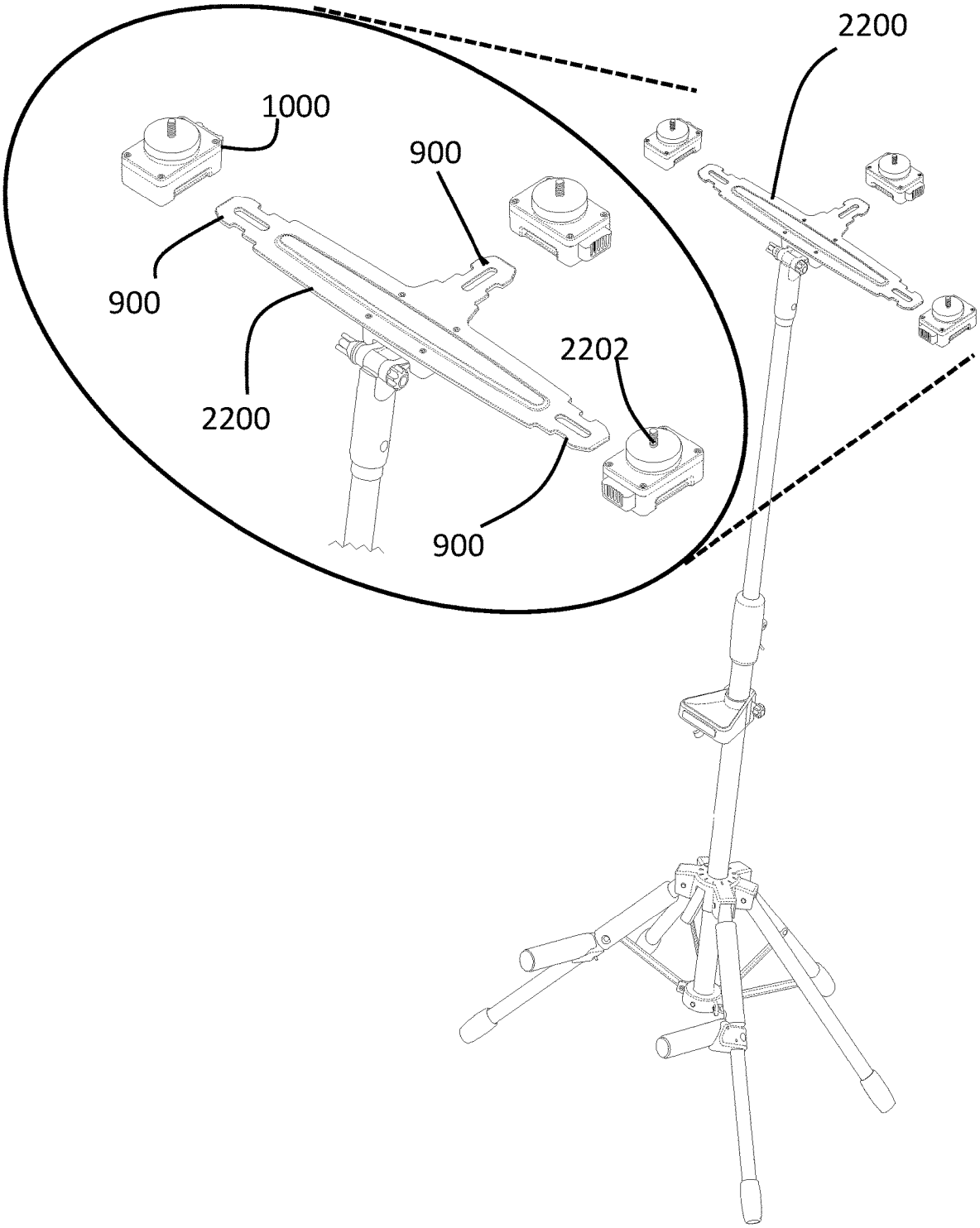
FIG. 22 is an illustration of the instrument and music stand according to various embodiments of the present invention, depicting an aspect that includes a plurality of tangs and a plurality of tang receptors.
Figure 23:
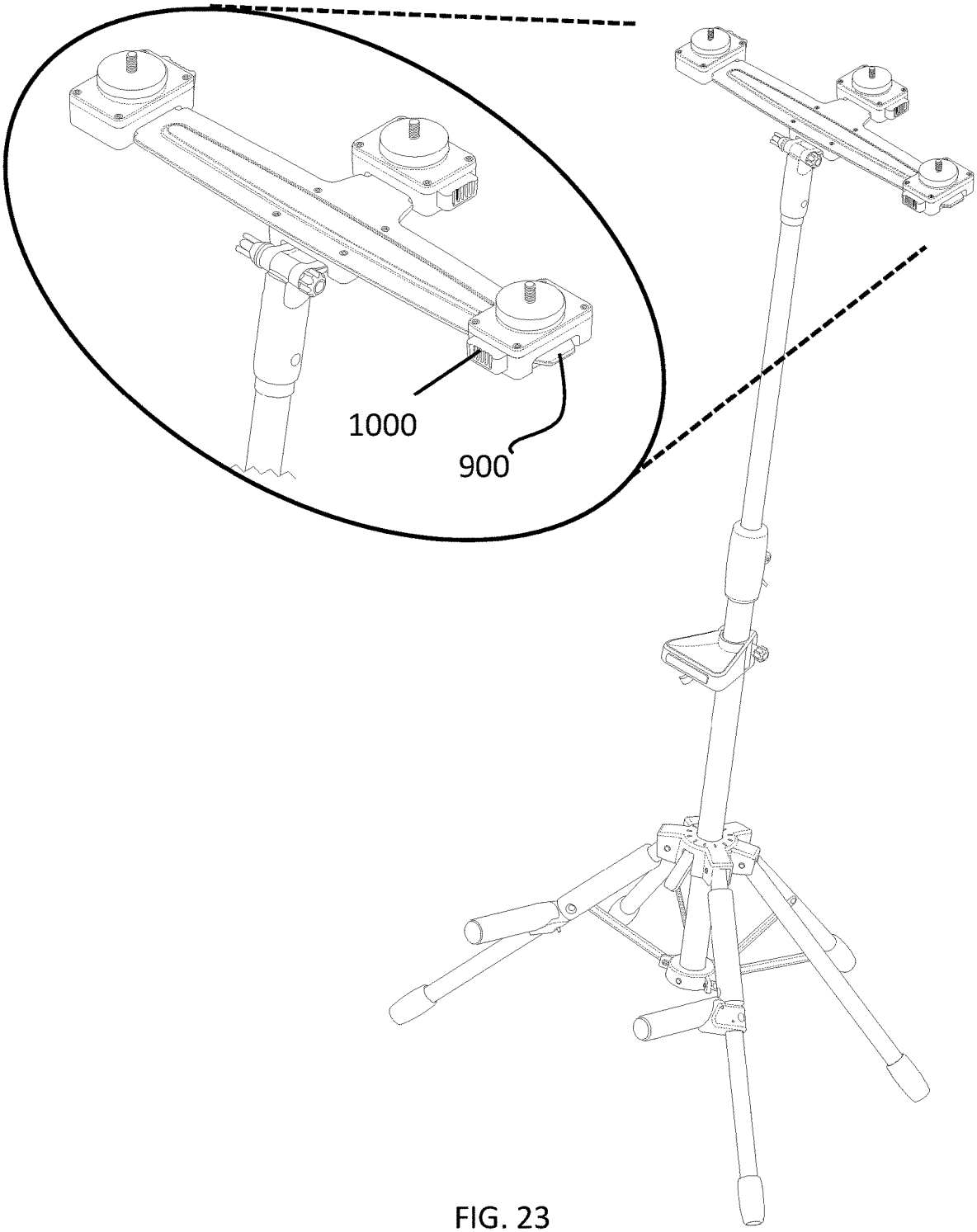
FIG. 23 is an illustration of the instrument and music stand according to various embodiments of the present invention, depicting an aspect that includes a plurality of tangs and a plurality of tang receptors.
Figure 24:
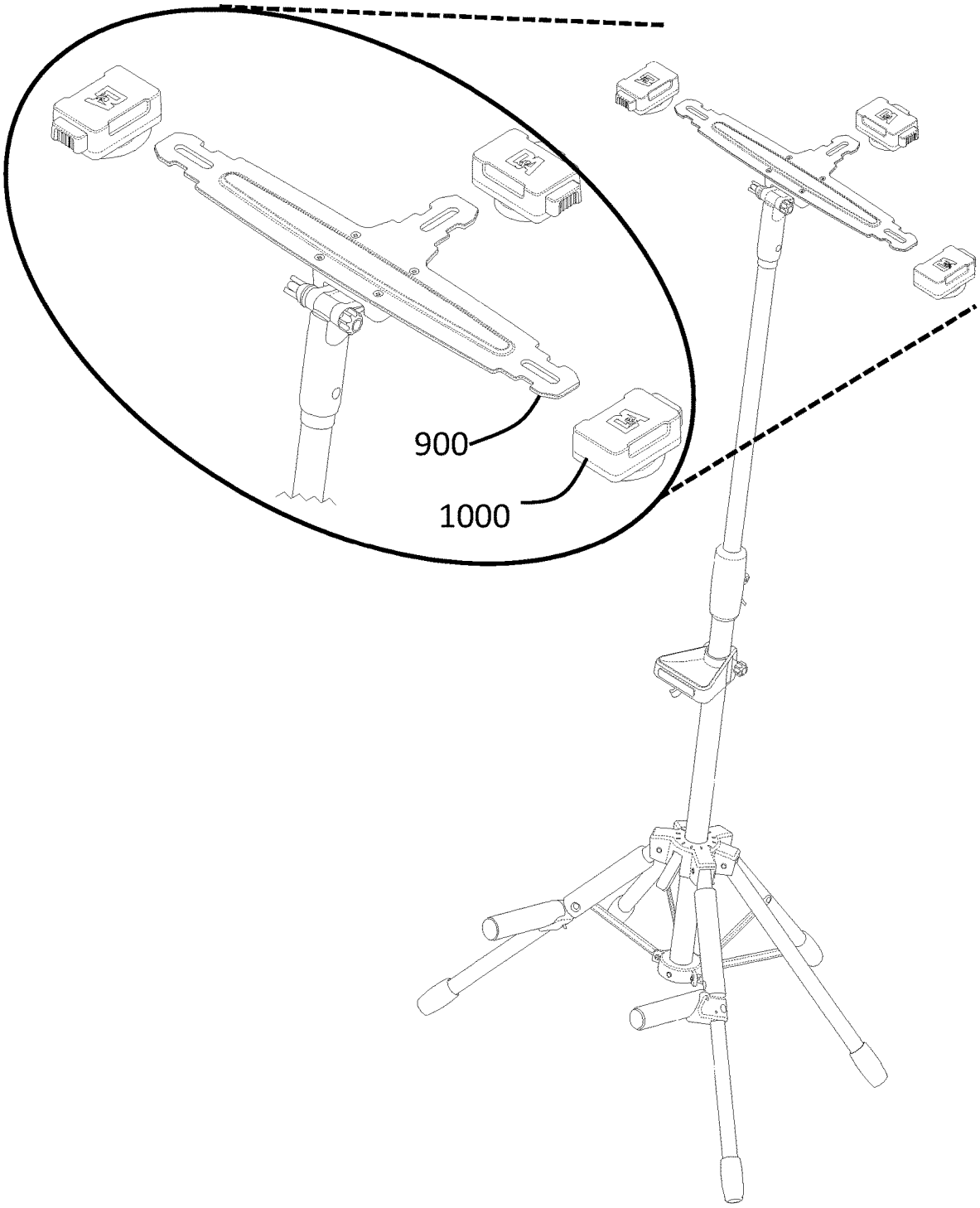
FIG. 24 is an illustration of the instrument and music stand according to various embodiments of the present invention, depicting an aspect that includes a plurality of tangs and a plurality of tang receptors.
Figure 25:
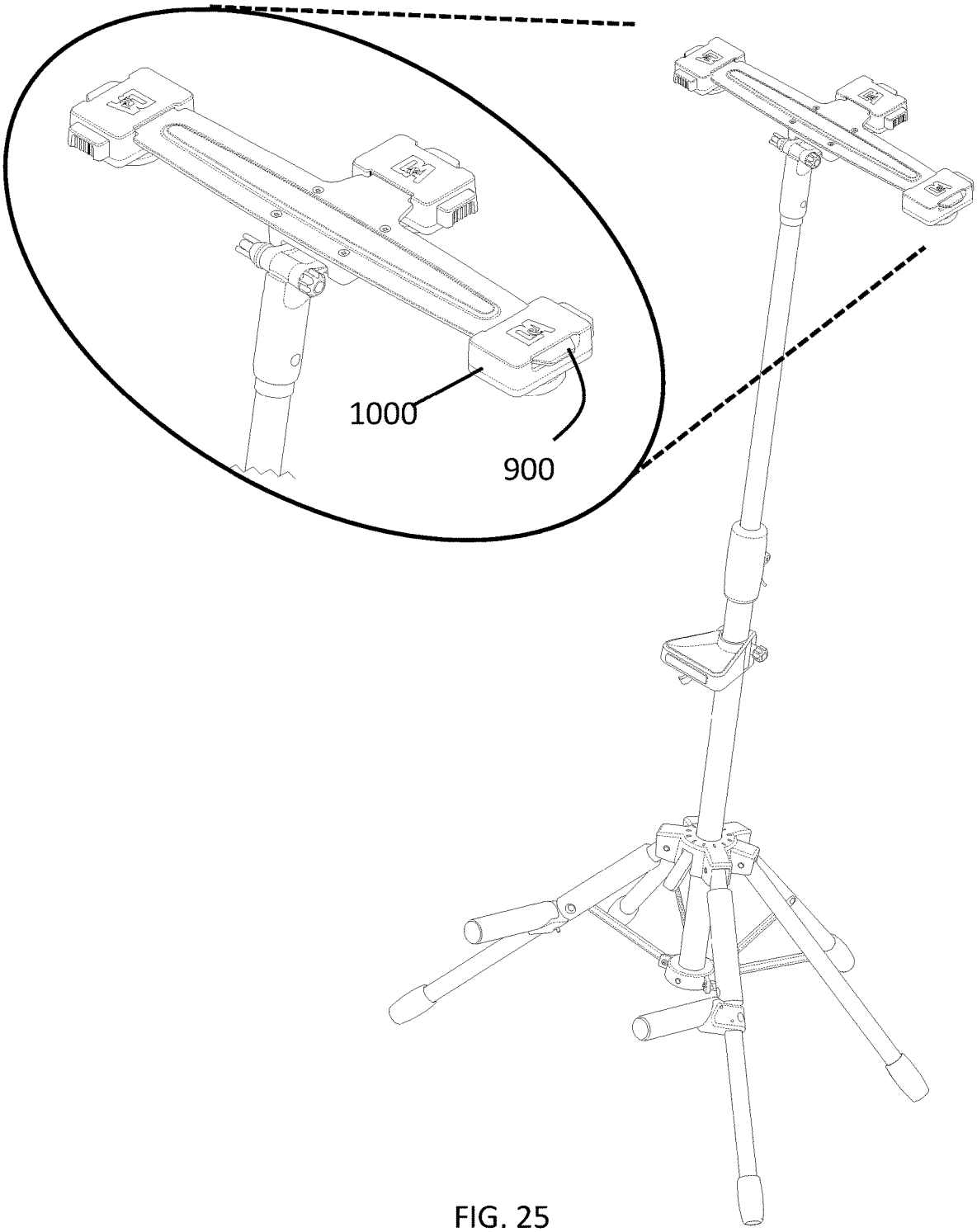
FIG. 25 is an illustration of the instrument and music stand according to various embodiments of the present invention, depicting an aspect that includes a plurality of tangs and a plurality of tang receptors.

As noted above, the music stand 100 is designed to provide several improvements over existing stands. For example, in some aspects and as shown in FIGS. 22 through 25, the stand 100 can be formed to have a tang plate 2200 with a plurality of attachment tangs 900 protruding therefrom. In this aspect, a tang receptor 1000 can be attached with each of the tangs 900. Each tang receptor 1000 can be formed to selectively attach with a variety of devices and instruments. For example, the tang receptor 1000 can be formed to include a threaded bolt 2202 that allows other devices to be selectively screwed onto a tang receptor 1000. FIG. 22 depicts the tang receptors 1000 as faced up and detached from the tangs 900, whereas FIG. 23 depicts the tang receptors as faced up and attached with the tangs 900. Alternatively, FIG. 24 depicts the tang receptors 1000 as faced down and detached from the tangs 900, whereas FIG. 25 depicts the tang receptors as faced down and attached with the tangs 900. Thus and as can be appreciated, the tangs 900 and tang receptors 1000 provide for a variety of configurations and uses.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. An instrument and music stand, comprising:

a base assembly having a plurality of legs;

a rod projecting up from the base assembly;

at least one attachment tang pivotally attached with the rod;

a tang receptor formed to selectively attach with the at least one attachment tang;

wherein the at least one attachment tang includes a pair of side recesses and wherein the tang receptor is formed to selectively attach with the at least one attachment tang by locking against the pair of side recesses; and wherein the tang receptor further comprises a button operably connected with a pair of geared detent parts, whereby depressing the button causes the pair of geared detent parts to simultaneously retract from the pair of side recesses of the at least one attachment tang for releasing the at least one attachment tang from the tang receptor.

2. The instrument and music stand as set forth in claim 1, further comprising a music holder affixed with the tang receptor.

3. The instrument and music stand as set forth in claim 2, wherein the music holder has two halves that are hingedly connected with one another by a pair of geared hinges.

4. The instrument and music stand as set forth in claim 3, wherein each geared hinge comprises two hinge parts with opposing faces, such that the opposing facings each have a magnet positioned therein.

5. The instrument and music stand as set forth in claim 4, wherein the tang receptor includes a top side and a bottom side, with the tang receptor being formed to receive and selectively attach with the at least one attachment tang from either the top or bottom side.

6. The instrument and music stand as set forth in claim 1, wherein the at least one attachment tang includes three attachment tangs connected with a tang plate, the tang plate being pivotally connected with the rod.

7. The instrument and music stand as set forth in claim 6, wherein the tang receptor includes a top side and a bottom side, with the tang receptor being formed to receive and selectively attach with a selected one of the three attachment tangs from either the top or bottom side.

* * * * *